US007467487B2

(12) United States Patent
Sato et al.

(10) Patent No.: US 7,467,487 B2
(45) Date of Patent: Dec. 23, 2008

(54) INDEX TAB, INDEX TAB BEARING SHEET AND METHOD OF USING AN INDEX TAB

(75) Inventors: Jay K. Sato, Aliso Viejo, CA (US); Norman Yamamoto, Yorba Linda, CA (US)

(73) Assignee: Avery Dennison Corporation, Pasadena, CA (US)

( * ) Notice: Subject to any disclaimer, the term of this patent is extended or adjusted under 35 U.S.C. 154(b) by 797 days.

(21) Appl. No.: 09/969,526

(22) Filed: Oct. 2, 2001

(65) Prior Publication Data

US 2002/0129526 A1 Sep. 19, 2002

Related U.S. Application Data

(60) Provisional application No. 60/277,141, filed on Mar. 19, 2001.

(51) Int. Cl.
*G09F 23/10* (2006.01)

(52) U.S. Cl. ..... 40/641; 40/359; 40/360

(58) Field of Classification Search ..... 40/641, 40/360, 359; 283/81, 41, 40, 36; 281/2, 281/46, 42; 402/79
See application file for complete search history.

(56) References Cited

U.S. PATENT DOCUMENTS

| | | | | | |
|---|---|---|---|---|---|
| 1,912,792 | A | * | 6/1933 | Perry | 40/641 |
| 1,936,944 | A | | 12/1933 | Tussing | |
| 1,983,878 | A | | 12/1934 | Rand | 40/16 |
| 2,016,259 | A | | 10/1935 | Schmitz | 40/16 |
| 2,061,675 | A | | 11/1936 | Schade | 129/1 |
| 2,507,659 | A | | 5/1950 | Zalkind | 40/23 |
| 2,541,791 | A | | 2/1951 | Taylor | 40/23 |
| 2,547,487 | A | | 4/1951 | Penney | 154/53.5 |
| 2,797,801 | A | * | 7/1957 | Bishop, Jr. | 206/447 |
| 2,815,595 | A | | 12/1957 | Davis | 40/23 |
| 3,221,430 | A | | 12/1965 | Cunningham | 40/23 |
| 3,269,391 | A | | 8/1966 | Wagner | 129/16.7 |
| 3,348,324 | A | * | 10/1967 | Cunningham | 40/641 |
| 3,444,635 | A | | 5/1969 | Setzler | 40/2 |
| 3,566,522 | A | | 3/1971 | Leach et al. | 40/23 |
| 3,924,744 | A | * | 12/1975 | Heimann | 206/460 |
| 4,137,658 | A | * | 2/1979 | Wos | 40/641 |
| 4,204,639 | A | | 5/1980 | Barber et al. | 235/462 |

(Continued)

FOREIGN PATENT DOCUMENTS

| | | |
|---|---|---|
| DE | 691798 | 5/1940 |

(Continued)

*Primary Examiner*—Cassandra Davis
(74) *Attorney, Agent, or Firm*—Patent Group Law Department

(57) ABSTRACT

Index tabs having a mechanism for alignment with an edge of a mounting sheet, and methods for making and using the same. Embodiments exemplary of the alignment mechanism include various stopper constructions, pocket constructions, and the like. For example, a pocket can be formed within an index tab, such that the pocket contains an opening at the bottom for receiving an edge of a mounting sheet. The edge of the mounting sheet becomes aligned with the index tab when it fully engages the top of the pocket, which acts as a stopper. After alignment is achieved, the index tab is adhered to the mounting sheet. Various shapes and materials that are beneficial in the new tab constructions are also disclosed.

92 Claims, 17 Drawing Sheets

U.S. PATENT DOCUMENTS

| | | | | |
|---|---|---|---|---|
| 4,232,461 | A | 11/1980 | Crawford | 40/23 |
| 4,961,666 | A | 10/1990 | Pitts et al. | 402/79 |
| 5,056,825 | A | 10/1991 | Templet | 283/36 |
| 5,103,756 | A * | 4/1992 | Korkames | 116/234 |
| 6,132,831 | A | 10/2000 | Thomas-Cote | |
| 6,385,860 | B1 | 5/2002 | MacWilliams et al. | |
| 6,694,526 | B1 * | 2/2004 | Tate | 2/209.12 |
| 7,055,861 | B1 * | 6/2006 | Lee | 281/42 |

FOREIGN PATENT DOCUMENTS

| | | | |
|---|---|---|---|
| GB | 2330112 | | 4/1999 |
| JP | 04004199 | A * | 1/1992 |

* cited by examiner

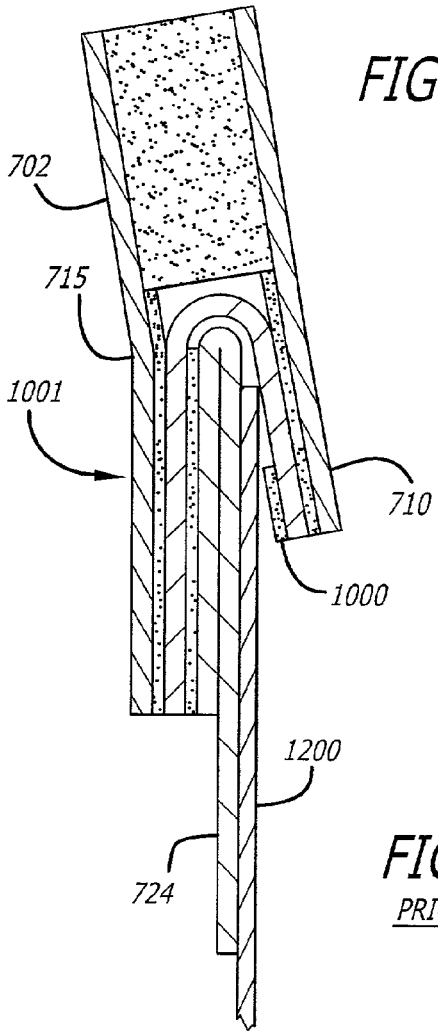
FIG. 12
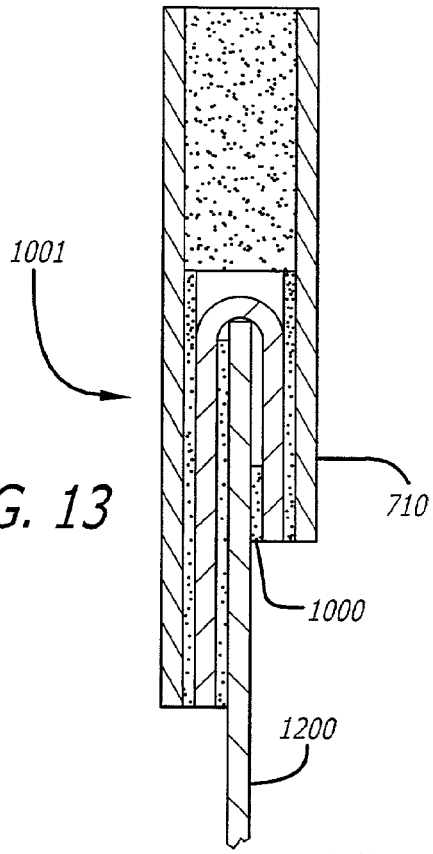
FIG. 13
FIG. 14
PRIOR ART
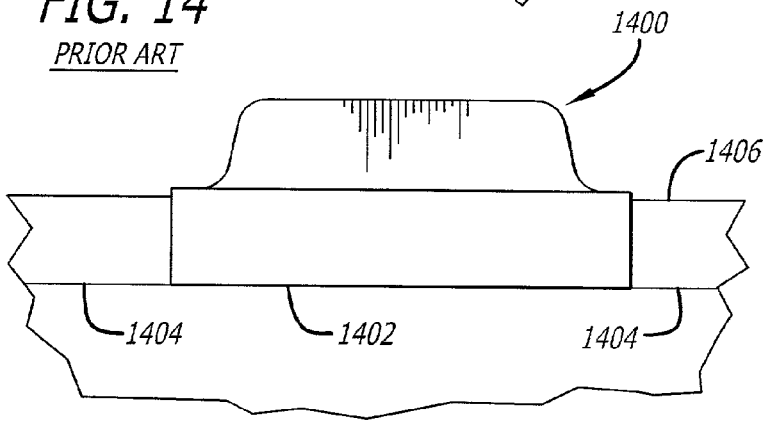
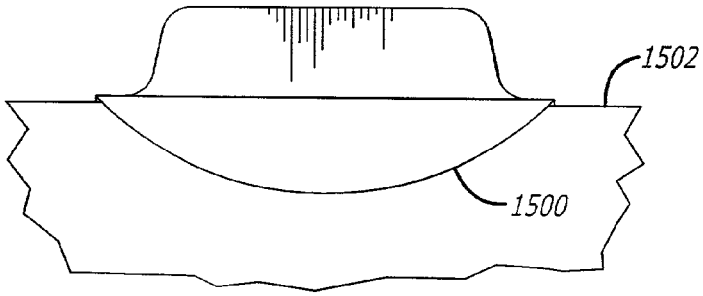
FIG. 15

FIG. 22
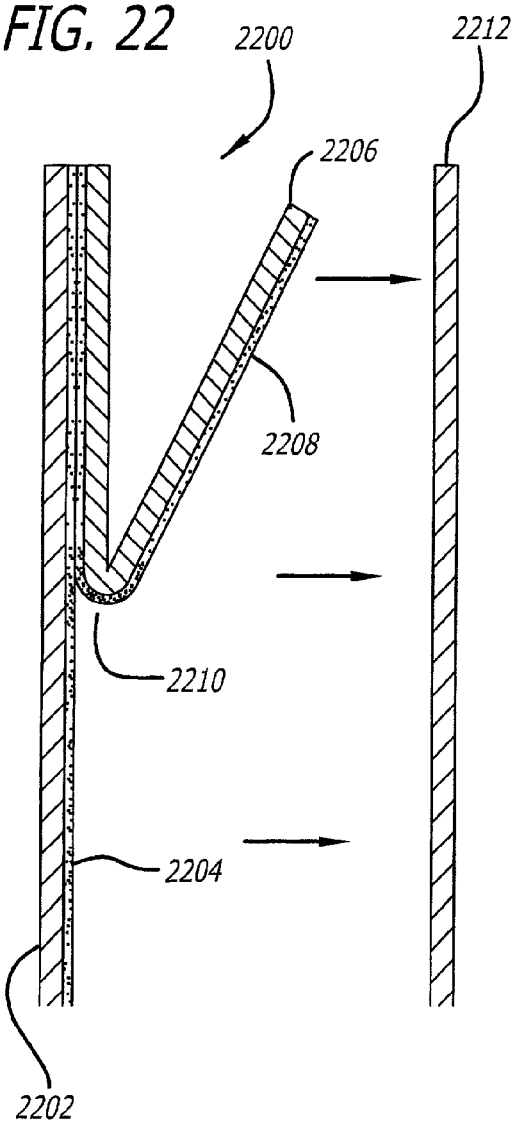
FIG. 24
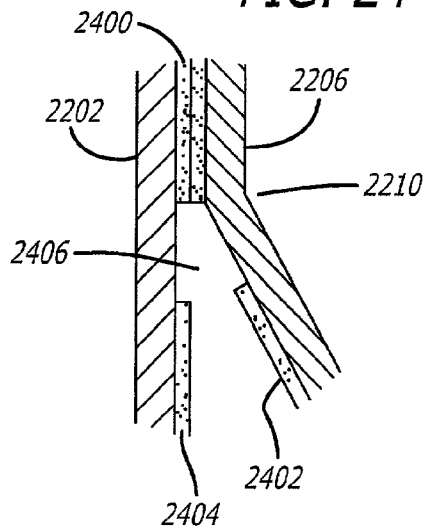
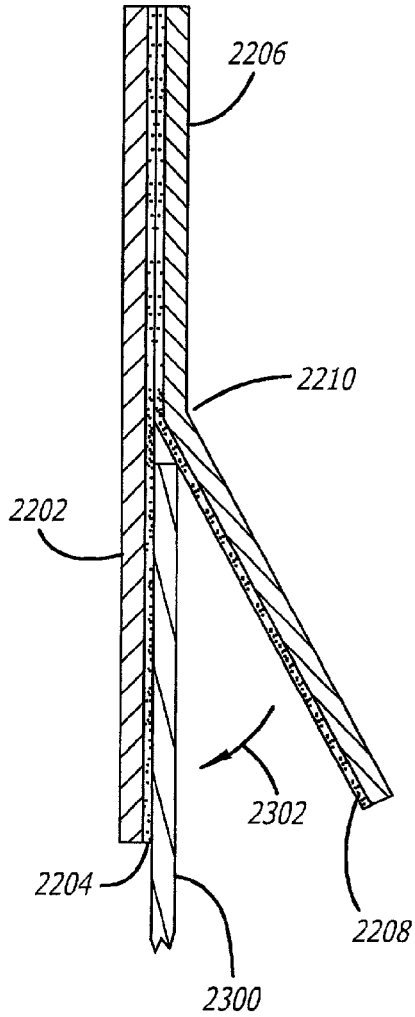
FIG. 23

INDEX TAB, INDEX TAB BEARING SHEET AND METHOD OF USING AN INDEX TAB

CROSS REFERENCE TO RELATED APPLICATION

This application claims the benefit of U.S. Provisional Patent Application No. 60/277,141, which was filed on Mar. 19, 2001 and is entitled "Stopper Aligning Tab Construction for Divider Sheets and the Like."

BACKGROUND OF THE INVENTION

1. Field of the Invention

The present invention relates to improvements in index tabs for use on divider sheets, filing cards and the like. More particularly, the present invention relates to index tabs that are easy to align along the edge of a divider sheet and easy to affix thereto.

2. General Background and State of the Art

Index tabs comprising a piece of material folded over upon itself to form a double ply tab having adhesive on its inside edges have been used extensively in the past. A number of problems are associated with the use of such tabs. These problems include difficulties with alignment and with adhering the tabs to divider sheets or other tab-bearing media.

A prior art index tab having a projecting bead on an adhesive covering skirt is disclosed in U.S. Pat. No. 2,541,791 (Taylor). The projecting bead is located on the skirt-covering adhesive on one side of the tab. The projecting bead is disposed such that the sheet of paper upon which the index tab is to be mounted is projected between the inner faces of the tab. The projecting bead can then be used to align that side of the tab with the edge of the mounting sheet, before the skirt is removed to expose the adhesive. There are several problems inherent to the tab design. For example, the projecting bead may become crushed or otherwise lose its rigidity and form if the two sides of the tab are pressed together. More importantly, the projecting bead allows for only one side of the index tab to be aligned with the mounting sheet. The other side of the index tab is left free, such that it cannot be easily aligned with the mounting sheet or with the other, mounted, side of the index tab. Therefore, the index tab may be unevenly mounted upon the mounting sheet. Additionally, as the skirt is removed to expose the adhesive, the projecting bead is necessarily removed. Thus, the alignment means is actually removed as the adhesive is exposed, such that when the tab is applied it may no longer be aligned with the mounting sheet at all.

U.S. Pat. No. 1,983,878 (Rand) discloses several index tab constructions having shoulders which form a catch or stop for positioning the index tab on a mounting sheet. Unfortunately, many of the shoulder constructions cause the tab portion of the index tab to lie outside of the plane of the mounting sheet. Additionally, all of the shoulder constructions provide a shoulder that is not attached to both lower tab extensions. That is, when the tab extensions are separated, such as to apply the tab to a mounting sheet, the edge of the mounting sheet may be inserted past the shoulder, to the very top of the tab. To prevent this, the tab extensions must be kept close together, to ensure that the shoulder engages the edge of the mounting sheet. This need to carefully control the separation of the tab extensions during the mounting procedure makes the procedure cumbersome.

SUMMARY OF THE INVENTION

A novel index tab of the present invention provides a pocket or a stop mechanism connected to the tab portion for aligning the tab accurately, and easily, with an edge of a mounting sheet. The stop mechanism engages the edge of a mounting sheet for alignment, yet requires no user control over other various parts of the index tab. That is, the stop mechanism is operatively connected to both sides of the index tab, such that the entire tab is pushed down, over the edge of the mounting sheet, by the user, without the user having to separate two sides of the tab. The two sides are separated by the width of the stop mechanism, and are both attached to the stop mechanism such that the user need not make any adjustments during application of the index tab to ensure that the stop mechanism actually engages the edge of the mounting sheet. Moreover, the index tab of the present invention is designed for easy positioning along the mounting sheet by either covering the adhesive until the tab is positioned, or by selective placement of the adhesive so that the tab can be freely positioned or slid along the card or divider edge even with the adhesive exposed. Also, the index tab of the present invention easily accommodates and secures mounting sheets of various thicknesses.

Thus, the present invention provides for a method of using or positioning tabs on a mounting sheet, such as a divider sheet.

The present invention further provides for an index tab which has an integral stopper or pocket for engaging the edge of a mounting sheet such that alignment is easy and requires little user control over the position and movement of various parts of the index tab during the application process.

The present invention even further provides for methods for manufacturing the inventive index tabs, as well as various alternative embodiments for the index tabs.

BRIEF DESCRIPTION OF THE DRAWINGS

FIG. 12 is a cross-sectional view illustrating the sixth exemplary index tab embodiment (FIG. 10) of the present invention being aligned with a mounting sheet prior to adhesion.

FIG. 13 is a cross-sectional view illustrating the sixth exemplary index tab embodiment (FIG. 10) of the present invention aligned with and adhered to a mounting sheet.

FIG. 14 is a front view of a prior art index tab applied to a mounting sheet.

FIG. 15 is a front view of an exemplary index tab applied to a mounting sheet according to the present invention.

FIG. 22 illustrates components of another alternative exemplary layered tab area.

FIG. 23 illustrates use of the alternative exemplary layered tab area illustrated in FIG. 22.

FIG. 24 illustrates an alternative construction of the alternative exemplary layered tab area illustrated in FIG. 22.

DETAILED DESCRIPTION OF PREFERRED EMBODIMENTS OF THE INVENTION

In the following description of the present invention reference is made to the accompanying drawings which form a part thereof, and in which is shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Figure 1:
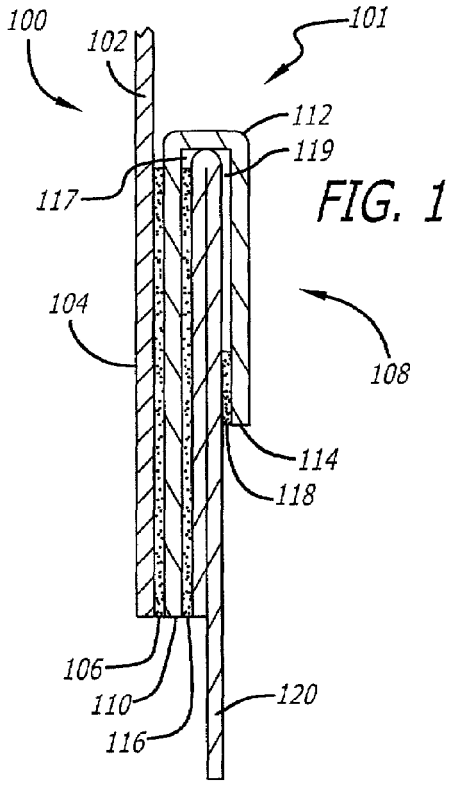
FIG. 1 is a cross-sectional view illustrating a first exemplary index tab embodiment of the present invention.

FIG. 1 is a cross-sectional view of an exemplary index tab 101 constructed according to the present invention. The exemplary tab comprises a single tab material layer 100 having a tab portion 102 and a tab extension 104. Tab material layer 100 may be constructed of any suitable tab material, such as card stock or various plastic materials. Tab extension 104 has a layer of adhesive 106 applied thereto. The adhesive may be any suitable adhesive such as, for example, glue, permanent tacky adhesive, or heat fusing. Adhesive layer 106 has a pocket 108 attached to it. Pocket 108 comprises a pocket extension 110, a top edge stopper 112, and a pocket hinge 114. These three portions of pocket 108 are preferably formed by folding a single piece of material over itself. Pocket hinge 114 is substantially shorter than pocket extension 110, to facilitate mounting of the tab construction onto a mounting sheet. It is to be understood that the characteristic shorter length of the pocket hinge, as compared to the length of the longer pocket extension, is applicable to all tab construction embodiments described in this application.

Continuing with FIG. 1, the internal surface of pocket extension 110 has a layer of adhesive 116 disposed thereon. Adhesive layer 116 is disposed such that a small gap 117 remains between the top edge of adhesive layer 116 and the inside top edge of stopper 112. Gap 117 may be included in all embodiments of the present invention and may be, for example, 1/16" to 1/8" from the inside top edge of stopper 112. Gap 117, in this embodiment and others, allows the tab construction 100 to slide along a mounting sheet edge without being hindered by adhesive. Likewise, the internal surface of pocket hinge 114 may have a layer of adhesive 118 applied along its lower edge portion. It is to be understood that adhesive layer 118 is an optional feature, and that this layer of adhesive on an inside surface of the hinge portion may be applied to any of the tab construction embodiments described in the application. This leaves a gap 119 between the top edge of adhesive layer 118 and the inside top edge of stopper 112, allowing the tab construction 100 to slide freely along a mounting sheet edge. These two layers of adhesive will secure the tab to a mounting sheet when it is attached.

Continuing with FIG. 1, a releasable backing 120 is applied to adhesive layer 116 to preserve the adhesive and prevent layers 116 and 118 from adhering to each other prior to attachment of the tab to a mounting sheet. Releasable backing 120 may be applied to layer 116 and folded over such that it also contacts and protects adhesive layer 118. The fold and configuration of releasable backing 120 facilitates easy removal of the backing once the tab has been positioned on the mounting sheet, and may be utilized with any of the tab construction configurations disclosed herein. Thus, an index tab of this invention has an integral stopper or pocket for engaging the edge of a mounting sheet such that alignment is easy and requires little user control over the position and movement of various parts of the index tab during the application process.

Figure 2:
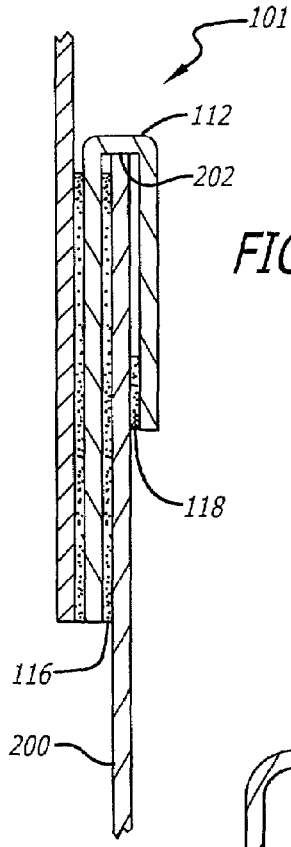
FIG. 2 is a cross-sectional view illustrating the first exemplary index tab embodiment (FIG. 1) of the present invention aligned with and attached to an edge of a mounting sheet.

The index tab construction described above can be easily aligned with and attached to an edge of a mounting sheet, such as a binder divider sheet, as illustrated in the cross-sectional view of FIG. 2. Stopper 112 engages an edge (such as a side or top) of divider sheet 200, indicated at 202. After releasable backing 120 is removed, mounting sheet 200 is secured to the tab between adhesive layers 116 and, optionally, 118. It is to be understood that in all embodiments disclosed herein, any adhesive layer disposed such that it will contact a mounting sheet may be either permanent or removable adhesive.

Figure 3:
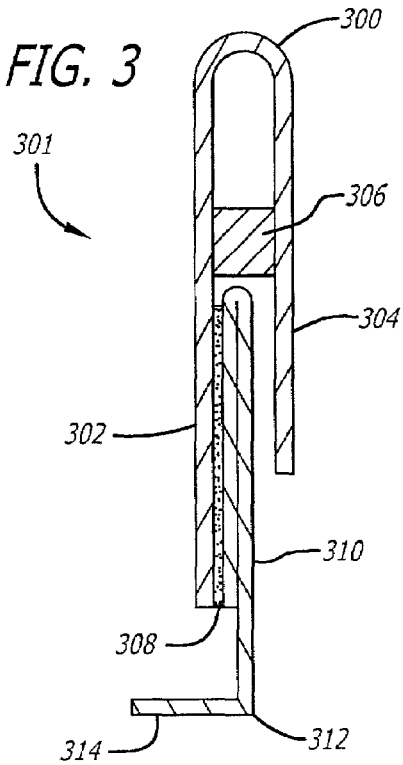
FIG. 3 is a cross-sectional view illustrating a second exemplary index tab embodiment of the present invention.

An alternative second embodiment 301 of the present invention is illustrated in the cross-sectional view of FIG. 3. The tab comprises a tab portion 300, a tab extension 302 and a tab hinge 304. Tab portion 300 may be formed by a piece of folded-over tab material to include a first and second tab side. It is to be understood that in all tab construction embodiments disclosed herein, the tab portion will include a first and second tab side, and may be constructed of a folded-over piece of tab material. Tab extension 302 and tab hinge 304 are separated from tab portion 300 by a stopper 306. Stopper 306, in the exemplary embodiment, comprises a heat fuse which joins the two sides of tab portion 300. An internal surface of tab extension 302 is coated with an adhesive layer 308, which is then covered by a releasable backing 310. Another feature of the present invention is that releasable backing 310 may be folded at area 312, to form an easily grippable tab 314 that is useful for exposing adhesive layer 308 during application of the tab construction to a mounting sheet. Easily grippable tab 314, in all embodiments, further facilitates removal of releasable backing 310. An additional feature that can be incorporated into the second exemplary embodiment is a second layer of adhesive on the inside surface of hinge 304. This second layer of adhesive would cause the attachment of the tab construction to a mounting sheet to be strengthened. Prior to mounting, the second layer of adhesive would be contacted and protected by releasable backing 310.

Figure 4:
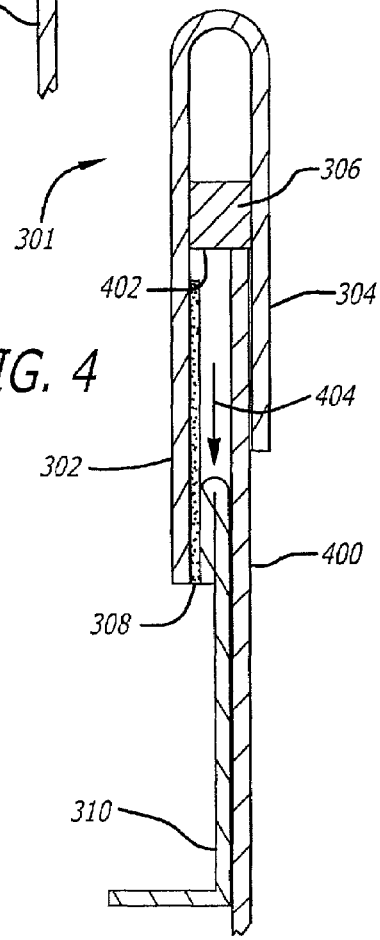
FIG. 4 is a cross-sectional view illustrating the second exemplary index tab embodiment (FIG. 3) of the present invention aligned with and attached to an edge of a mounting sheet.

The second exemplary embodiment 301 of the present invention as it is applied to a mounting sheet 400 is depicted in FIG. 4. Lower edge 402 of heat fuse 306 is aligned with an edge of mounting sheet 400 prior to application. Then, releasable backing 310 is pulled downward, as indicated at arrow 404, to expose adhesive layer 308. Tab extension 302 and hinge 304 are then pressed together to engage adhesive layer 308 with divider sheet 400, securing the tab in place.

Figure 5:
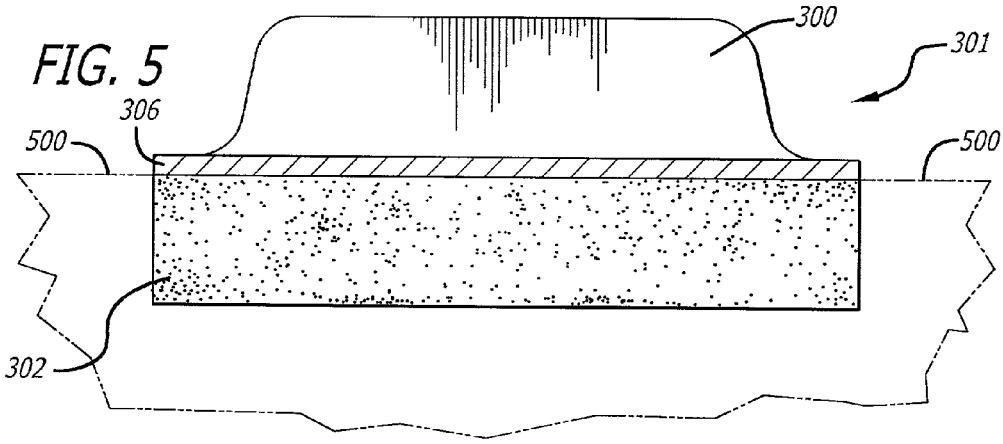
FIG. 5 illustrates a front view of the second exemplary index tab embodiment of the present invention.
Figure 6:
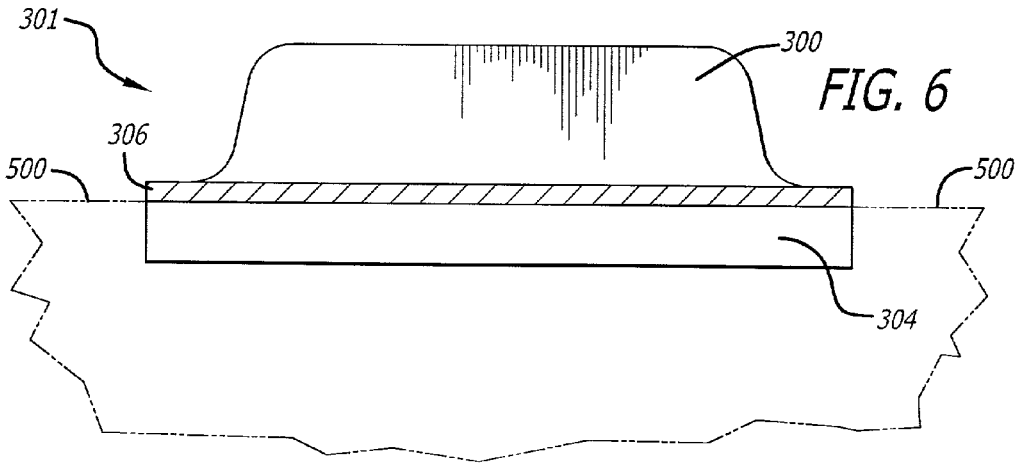
FIG. 6 illustrates a back view of the second exemplary index tab embodiment of the present invention.

FIGS. 5 and 6 illustrate front and rear views, respectively, of an exemplary index tab according to the present invention. An edge 500 of a mounting sheet is aligned with the tab at heat fuse stopper 306. Tab portion 300 extends above mounting sheet edge 500. In the front view, tab extension 302 extends below mounting sheet edge 500 and is adhered to the mounting sheet by the underlying adhesive layer. In the rear view, tab hinge 304 also extends below mounting sheet edge 500, though not as far as the length of tab extension 302. The short length of tab hinge 304 enables the tab to be more easily positioned onto the edge of the mounting sheet. In any exemplary embodiment, described herein, tab hinge 304 may be at least ⅛ inch shorter than tab extension 302.

Figure 7:
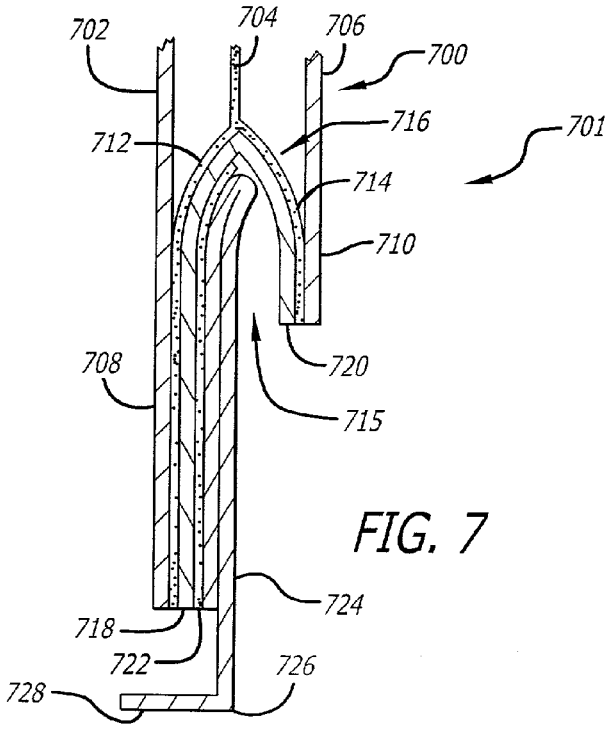
FIG. 7 is a cross-sectional view illustrating a third exemplary index tab embodiment of the present invention, aligned with and attached to an edge of a mounting sheet.

A third exemplary embodiment 701 of the present invention is illustrated in FIG. 7. In this cross-sectional view, it can be seen that tab portion 700 comprises three layers of material; namely, a first outside tab portion 702 comprised of suitable tab material such as card stock or plastic, an internal layer of adhesive 704, and a second outside tab portion 706 also comprised of card stock or plastic. Internal adhesive layer 704 binds the two outside tab portions 702 and 706 together. The piece of material which forms first outside tab portion 702 extends downward to form tab extension 708. Likewise, the piece of material which forms outside tab portion 706 extends downward to form tab hinge 710. A pocket, shown generally at 715, is then formed and adhered to the inside surfaces of tab extension 708 and tab hinge 710 with adhesive layers 712 and 714, respectively. The pocket 715 comprises a single piece of material, such as a strip of paper for example, folded to form stopper 716 and two extensions therefrom: pocket extension 718 and pocket hinge 720. Specifically, pocket extension 718 is adhered to inside surface of tab extension 708 by adhesive layer 712, and pocket hinge 720 is adhered to inside surface of tab hinge 710 by adhesive layer 714. A layer of adhesive 722 is applied to internal surface of pocket extension 718, and covered with releasable backing 724. Releasable backing 724 can be folded over, extend downward, and include a second fold as indicated at 726 to form an easily grippable tab 728 which is useful for removing releasable backing 724 from the tab to expose adhesive 722 after the tab has been aligned on the divider sheet.

Figure 8:
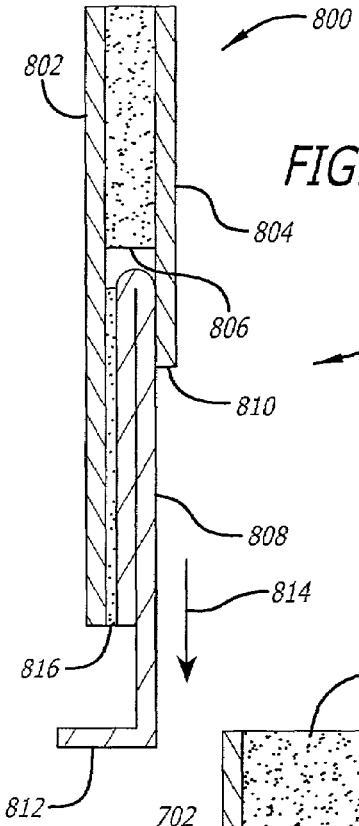
FIG. 8 is a cross-sectional view illustrating a fourth exemplary index tab embodiment of the present invention.

FIG. 8 illustrates a fourth exemplary embodiment 801 of the invention. In this embodiment, tab portion 800 comprises a first tab portion layer 802 and a second tab portion layer 804, connected by an adhesive layer 806. Lower edge of adhesive layer 806 acts as a stopper for aligning the tab with an edge of a mounting sheet as in the previously described embodiments. In this embodiment, a mounting sheet may be inserted between releasable backing 808 and tab hinge 810. Then releasable backing 808 is grasped at easily grippable tab 812 and pulled downward as indicated by arrow 814 to expose adhesive layer 816 which will adhere to the surface of the mounting sheet. Once the tab is mounted upon the mounting sheet, the tab is aligned, via adhesive stopper 806, with the top edge of the mounting sheet. An additional feature that can be incorporated into the fourth exemplary embodiment is a second layer of adhesive on the inside surface of hinge 810. This second layer of adhesive would cause the attachment of the tab construction to a mounting sheet to be strengthened. Prior to mounting, the second layer of adhesive would be contacted and protected by releasable backing 808.

Figure 9:
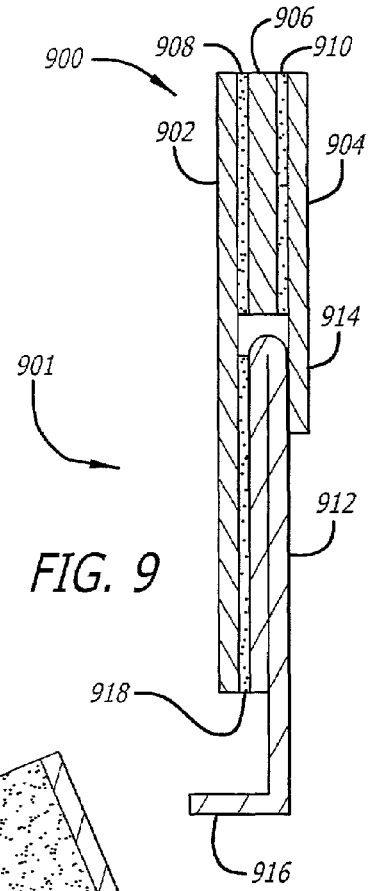
FIG. 9 is a cross-sectional view illustrating a fifth exemplary index tab embodiment of the present invention.
Figure 10:
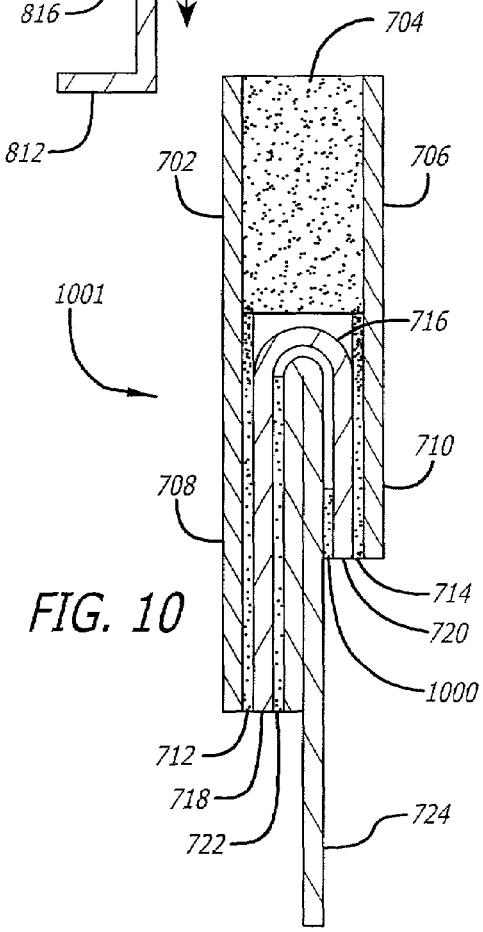
FIG. 10 is a cross-sectional view illustrating a sixth exemplary index tab embodiment of the present invention.

FIG. 9 illustrates yet a fifth exemplary embodiment 901 of the invention. In this embodiment, tab portion 900 comprises a first tab portion layer 902, a second tab portion layer 904, and a tab portion stopper 906 connected to tab portion layers 902 and 904 by adhesive layers 908 and 910, respectively. Tab portion stopper 906 may be constructed out of any suitable material, such as card stock, and is used to align the tab with an edge of a mounting sheet. The mounting sheet can be inserted upwardly into tab portion 900 between releasable backing 912 and hinge 914. After the edge of the mounting sheet is sufficiently aligned with the lower edge of stopper 906, releasable backing 912 is grasped at its easily grippable tab 916, and pulled downward to expose adhesive layer 918 which then affixes the tab assembly to a surface of the mounting sheet, while the alignment previously described is easily maintained and not disturbed.

Figure 11:
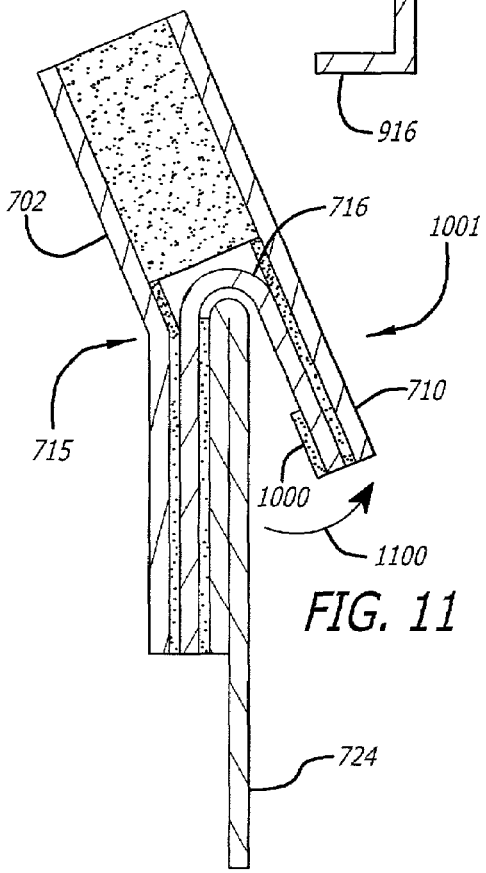
FIG. 11 is a cross-sectional view illustrating an operational feature of the sixth exemplary index tab embodiment (FIG. 10) of the present invention.

FIGS. 10 through 13 are cross-sectional views which illustrate certain operational features of a sixth exemplary embodiment 1001 of the present invention. This embodiment incorporates an additional feature to the third exemplary embodiment of the invention, which was previously described herein with reference to FIG. 7. An additional strip layer of adhesive, 1000, is added along the lower edge of pocket hinge 720. As shown in FIG. 11, hinge 710 may be moved outward as indicated at arrow 1100, which causes adhesive strip 1000 to easily release from releasable backing 724. A mounting sheet 1200 may then be inserted between releasable backing 724 and strip adhesive 1000, and aligned with pocket stopper 716. As shown in FIG. 12, the entire tab assembly may be slid across the upper edge of mounting sheet 1200 until the proper position is achieved. During this alignment process, adhesive strip 1000 does not interfere with positioning of the tab. Adhesive strip 1000 is strategically designed to not interfere with tab positioning in its location on the edge of pocket hinge 720 and in the slight bend 715 in outside tab portion 702 which causes hinge portion 710 to angle away from mounting sheet 1200 As illustrated in FIG. 13, hinge 710 can be lowered to engage now-exposed adhesive strip 1000 with a surface of the mounting sheet.

Another feature of the present invention is applicable to all previously described embodiments. This feature addresses a problem of prior art tabs as illustrated in FIG. 14. It can be seen that conventional tabs 1400 having a linear lower edge 1402, will cause a crease 1404 in mounting sheet 1406 with continual use of the sheet, such as by turning pages in a binder. A novel feature of the present invention comprises a curved shape for bottom tab edge 1500 as illustrated in FIG. 15. The curved edge reduces creasing of the mounting sheet 1502, even with repeated use. It will be appreciated by those skilled in the art that curved bottom tab edge 1500 may be implemented in any of the tab construction embodiments disclosed herein.

Figure 16:
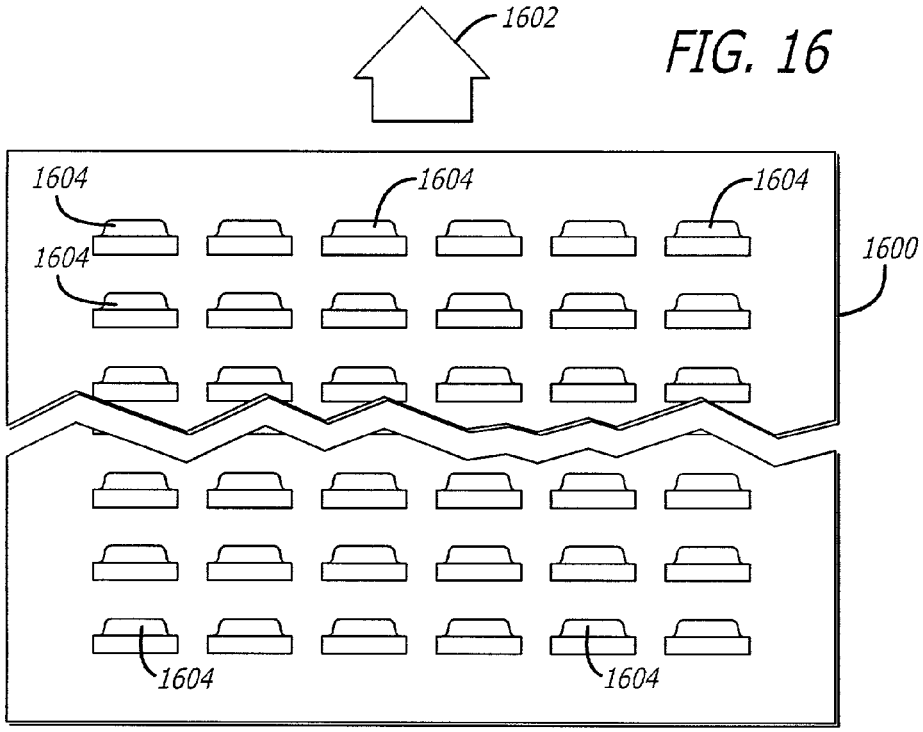
FIG. 16 illustrates a full sheet of multiple tabs according to the present invention, the sheet being capable of passing through a printing machine for printing thereon.
Figure 17:
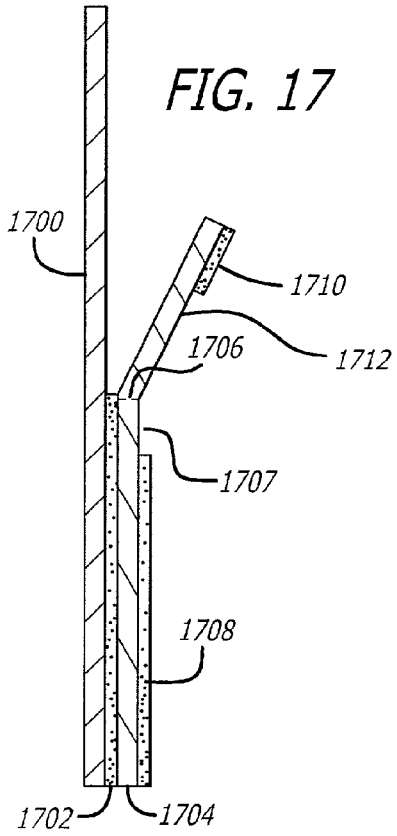
FIG. 17 is a cross-sectional view illustrating an exemplary tab area of the full sheet illustrated in FIG. 16.

Some of the various exemplary embodiments of the present invention can be practiced such that multiple tabs are constructed within a single sheet 1600, as indicated in FIG. 16. This sheet 1600 can be passed through a printer as indicated by arrow 1602 such that the tab areas 1604 can have indicia printed thereon. To describe the construction of such a sheet, the construction of a single tab area therein is illustrated in FIG. 17. The tab area comprises a first layer of tab material 1700 suitable for being passed through a printer, such as thin polyester or flexible card stock. An adhesive layer 1702 is then applied to a lower portion of tab material layer 1700. A pocket material layer 1704 is applied to and extends beyond adhesive layer 1702. A pocket fold line 1706 is formed along the upper edge of adhesive layer 1702. Pocket fold line 1706 may be, for example, a score line. Another layer of adhesive 1708 is then applied to the portion of pocket material layer 1704, below pocket fold line 1706. A region 1707 having no adhesive remains below pocket fold line 1706. Adhesive-free regions 1707 may be, for example, between 1/16" and 1/8", as measured between top edge of adhesive layer 1708 and pocket fold line 1706. An additional strip of adhesive 1710 is applied to the upper edge of pocket material layer 1704, above pocket fold line 1706. Again, adhesive 1710 is applied such that a region 1712, having no adhesive thereon, is located above pocket fold line 1706.

Figure 18:
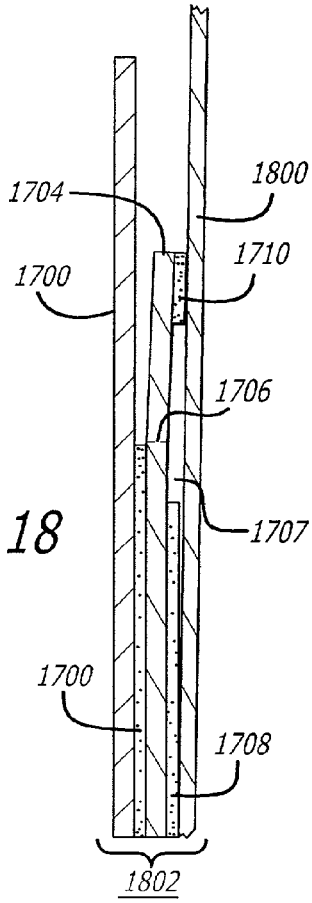
FIG. 18 is a cross-sectional view illustrating the exemplary tab area of FIG. 17 having a releasable backing applied thereto.

Finally, as indicated in FIG. 18, a releasable backing sheet 1800 is applied to the entire tab area construction, being adhered to adhesive layer 1708 and adhesive strip 1710. This releasable backing sheet 1800 thereby becomes tab-bearing sheet 1600. The thickness 1802 of the sheet and tab areas must be sufficiently small that the sheet can pass through printers within their standard clearances without jamming. For example, an ideal thickness would be less than 15.0 mils. or, more preferably, less than 9.0 mils. In any case, the preferred thickness could be determined according to standard machining techniques and printing machine tolerances. Thickness 1802 is measured as the summation of the individual thicknesses of the various layers, and can be minimized through optimization of these layers. In addition, the tab-bearing sheet assembly must be further optimized to ensure that the adhesive and releasable backing bond strength is sufficient to keep the tabs adhered to the backing sheet as the entire sheet is passed through the printer, but weak enough that the tabs can be removed easily by a user, after printing. Also, the sheet must be flexible such that the tab-bearing sheet can be passed through the printer rollers without becoming jammed therein.

Figure 19:
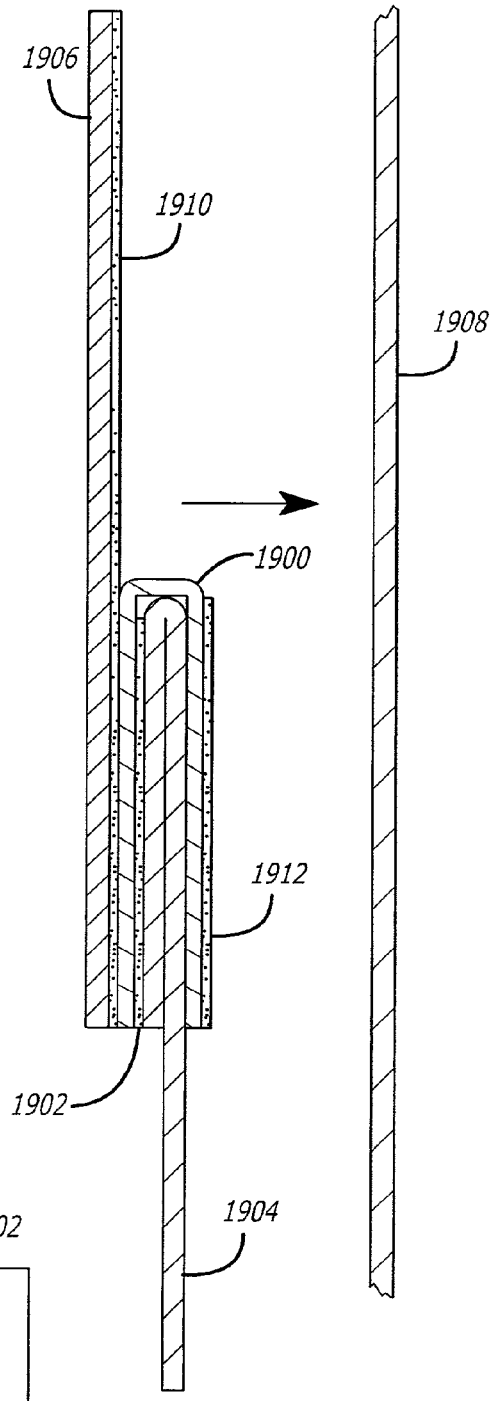
FIG. 19 is a cross-sectional view of an alternative exemplary layered tab area.

Although the design objectives of the tab-bearing sheet will be the same, other designs for the tabs on the sheet are within the scope of the present invention. For example, FIG. 19 illustrates a pocket assembly comprising a folded-over pocket layer 1900 having an adhesive layer 1902 and releasable backing layer 1904 therebetween and sandwiched between tab material layer 1906 and releasable backing sheet 1908. Adhesive layers 1910 and 1912 bind the pocket assembly between tab material layer 1906 and releasable backing sheet 1908. Each of these tabs can be removed from the tab-bearing sheet and aligned with and applied to a mounting sheet as previously described herein. Although manufacturing methods are described later in the application, it should be noted that in all index tab-bearing sheet embodiments described herein, manufacturing steps may occur in any order regardless of the order in which the components of index tab-bearing sheet embodiments are described. That is, the layers of such a sheet, as their descriptions are ordered herein, do not necessarily correspond to the order in which the sheet must be constructed. Steps for constructing the index tab-bearing sheets may occur in any order.

Figure 20:
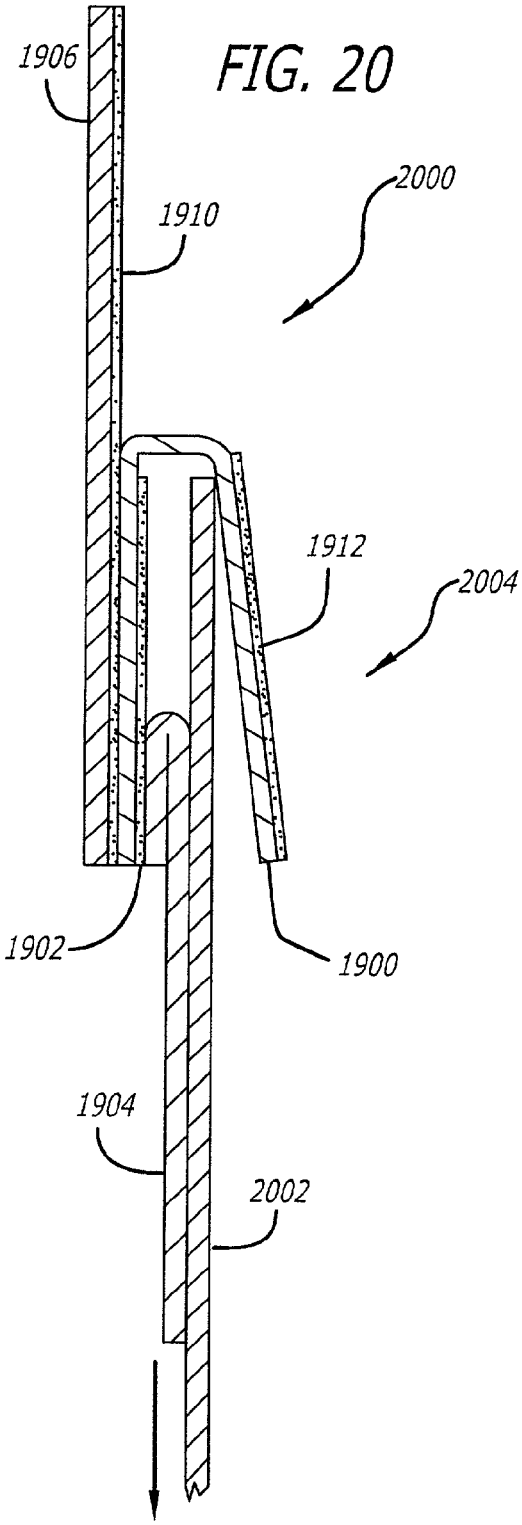
FIG. 20 illustrates use of the alternative exemplary layered tab area illustrated in FIG. 19.
Figure 21:
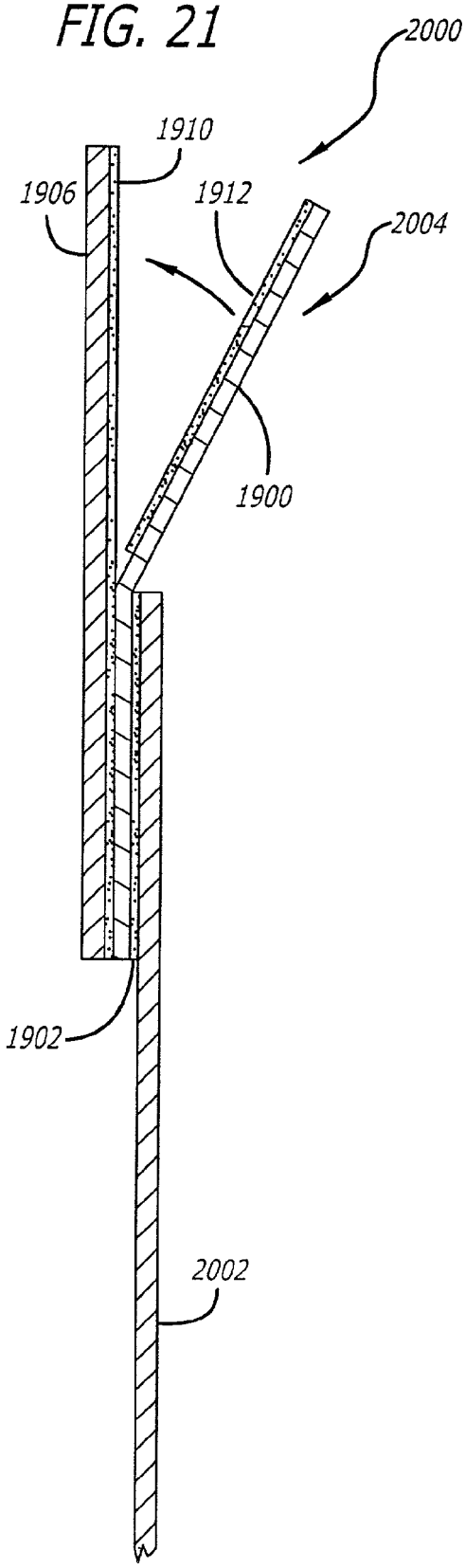
FIG. 21 illustrates use of the alternative exemplary layered tab area illustrated in FIG. 19.

FIGS. 20 and 21 illustrate how a tab 2000 from a tab-bearing sheet, tab 2000 constructed as in FIG. 19, would be utilized. A mounting sheet 2002 is inserted between releasable backing 1904 and outer side 2004 of pocket 1900, shown in FIG. 20. Releasable backing 1904 is then removed, and adhesive layer 1902 contacts mounting sheet 2002, securing the tab construction thereto. Referring to FIG. 21, once the tab construction is aligned with and secured to mounting sheet 2002, outer pocket side 2004 is folded upward, such that adhesive layer 1912 binds to adhesive layer 1910. This completes the tab assembly after it is mounted upon and aligned with mounting sheet 2002.

Figure 22A:
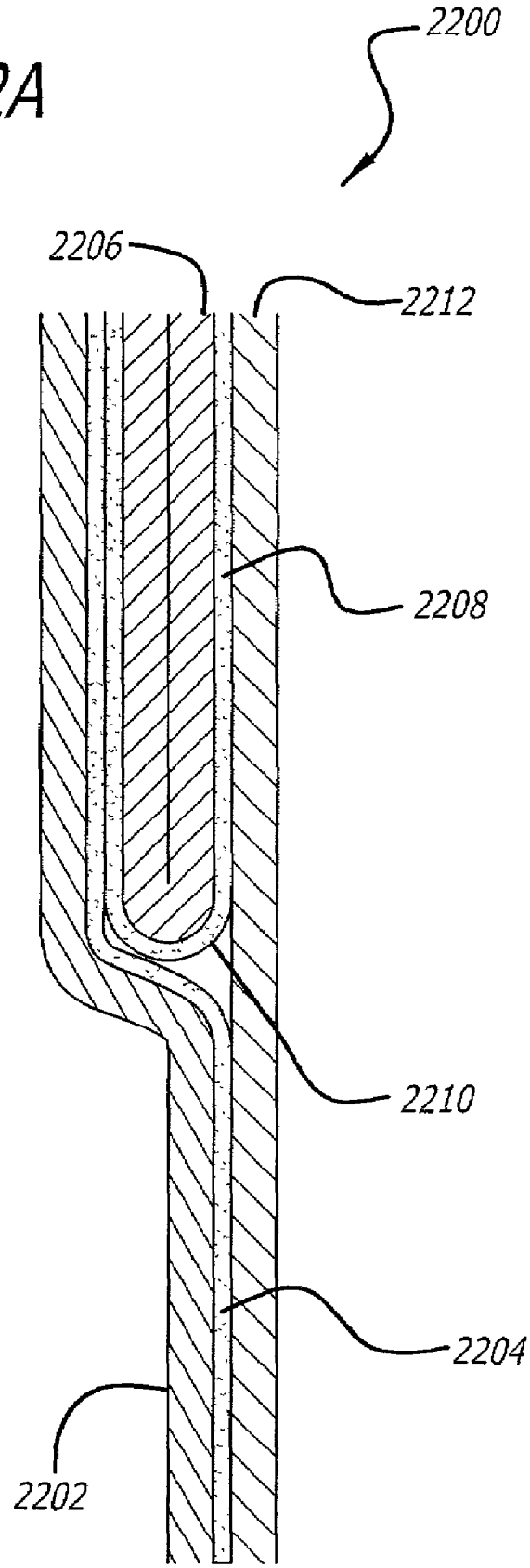
FIG. 22A illustrates the assembled components of the layered tab area of FIG. 22.

Another exemplary embodiment is shown in FIG. 22, which illustrates an exemplary tab area 2200 contained on a tab-bearing sheet. A first layer of tab material 2202 has a first layer of adhesive 2204 applied thereon. A pocket assembly is then formed by providing a second layer of tab material 2206 and applying a second layer of adhesive 2208 thereon. The pocket is formed by creating fold 2210. Backing sheet 2212 is then applied, such that it contacts adhesive layers 2204 and 2208. This is illustrated in FIG. 22A.

Once removed from backing sheet 2212, the tab construction above is used as illustrated in FIG. 23. Mounting sheet 2300 is adhered to adhesive layer 2204. The outer portion of the pocket is then folded downward, as indicated at fold line 2210 and arrow 2302. Adhesive layer 2208 will contact mounting sheet 2300, causing the tab assembly to be completely secured to the mounting sheet 2300.

As an alternative embodiment to the tab area described above and illustrated in FIGS. 22 and 23, adhesive layers 2208 and 2204 may comprise three separate adhesive layers. This alternative construction is illustrated in FIG. 24, which illustrates the tab assembly as generally shown in the region of fold line 2210. Specifically, a first adhesive layer 2400 may be disposed between the upper portion of tab material layer 2202 and the inner portion of pocket material layer 2206. A second adhesive layer 2404 is applied to the lower portion of tab material layer 2202. Finally, a third adhesive layer 2402 is applied to the inner portion of pocket material layer 2206. As indicated at region 2406, the three layers of adhesive are non-continuous. This serves both to facilitate the bending which occurs at fold line 2210 and to allow the tab construction to slide freely along the edge of mounting sheet 2300 before securing into the desired position.

Figure 25:
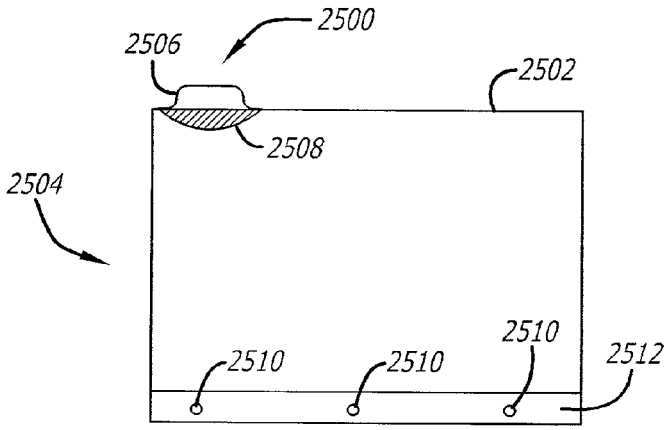
FIG. 25 illustrates a mounting sheet having an exemplary tab according to the present invention aligned with an edge thereof and attached thereto.

FIG. 25 illustrates a mounted tab, generally shown at 2500, according to various embodiments of the present invention, aligned with the top edge 2502 of a mounting sheet 2504. Tab 2500 includes a tab portion 2506 which extends upward past the edge of mounting sheet edge 2502. Tab 2500 further includes a lower portion 2508 attached to mounting sheet 2504. According to various embodiments of the present invention, lower portion 2508 may comprise, for example, a tab extension, a tab hinge, a pocket, a pocket hinge or a stopper, to name a few possibilities. Of course, it is anticipated as being within the scope of the invention for lower portion 2508 to include any of a number of attachment constructions as described herein. Mounting sheet 2504 may be, for example, a divider sheet such as for use within a binder. Such a divider sheet may include binder holes 2510 and a reinforcing strip 2512 for providing binder holes 2510 with additional strength. Although tab 2500 is shown on edge 2502 directly opposite binder holes 2510, it is anticipated that tab 2500 may be located on any edge of mounting sheet 2504 and is not limited in its placement. Further, once mounted, tab 2500 is aligned with any of said edges of mounting sheet 2504 according to methods and constructions of the present invention.

Figure 26:
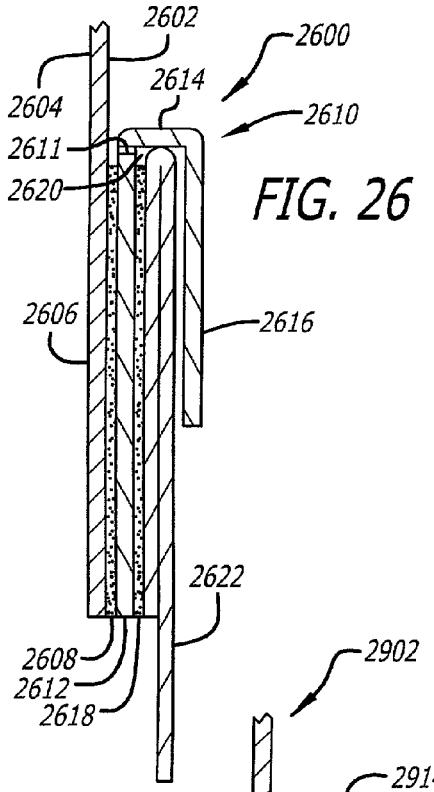
FIG. 26 is a cross-sectional view illustrating a seventh exemplary perforated index tab embodiment of the present invention.

FIG. 26 is a cross-sectional view of a seventh exemplary index tab construction 2600 according to the present invention. The exemplary tab construction is a perforated tab construction. The exemplary tab comprises a single tab material layer 2602 having a tab portion 2604 and a tab extension 2606. Tab material layer 2602 may be constructed of any suitable tab material, such as card stock or various plastic materials. Tab extension 2606 has a layer of adhesive 2608 applied thereto. The adhesive may be any appropriate adhesive such as, for example, glue, permanent tacky adhesive, or heat fusing. Adhesive layer 2608 has a pocket 2610 attached to it. Pocket 2610 comprises a pocket extension 2612, a top edge stopper 2614, and a pocket hinge 2616. These three portions of pocket 2610 are preferably formed by folding a single piece of material over itself. Additionally, pocket 2610 comprises a weakened portion such as with a perforation 2611, located such that pocket hinge 2616 and top edge stopper 2614 may be removed from pocket extension 2612 by tearing at perforation 2611. Perforation 2611, for example, may be located at the fold which forms the three portions of pocket 2610, or near the fold, such as within 1/16" of the fold. The internal surface of pocket extension 2610 has a layer of adhesive 2618 disposed thereon. Adhesive layer 2618 is disposed such that a small gap 2620 remains between the top edge of adhesive layer 2618 and the inside top edge of stopper 2614.

As described previously, gap 2620 may be included in all embodiments of the present invention and may be, for example, 1/16" to 1/8" from the inside top edge of stopper 2614. Gap 2620, in this embodiment and others, allows the tab construction 2600 to slide along a mounting sheet edge without being hindered by adhesive. Once exposed, however, adhesive layer 2618 will secure the tab to a mounting sheet when it is attached. A releasable backing 2622 is applied to adhesive layer 2618 to preserve the adhesive and prevent it from adhering to the internal surface of pocket hinge 2616 prior to attachment of the tab to a mounting sheet. Thus, an index tab of this invention has an integral stopper or pocket for engaging the edge of a mounting sheet such that alignment is easy and requires little user control over the position and movement of various parts of the index tab during the application process.

Figure 27:
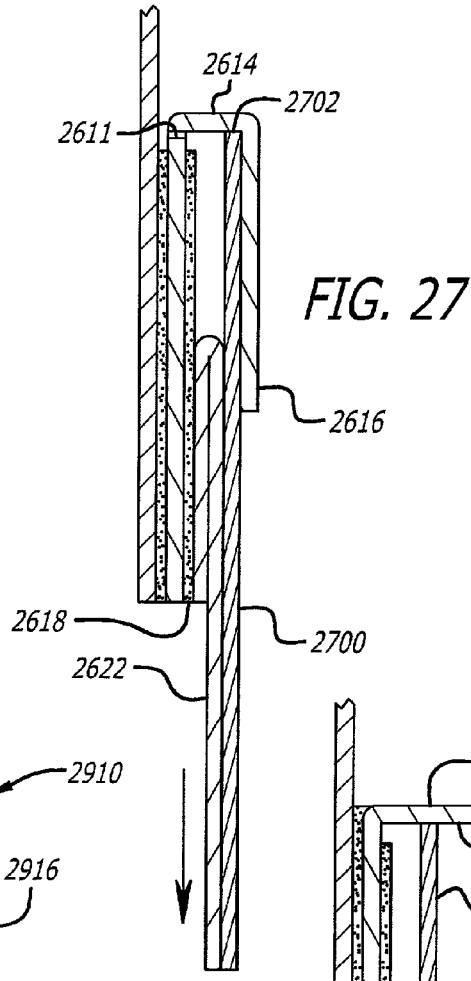
FIG. 27 illustrates application of the exemplary perforated tab construction shown in FIG. 26 to the edge of a mounting sheet.

The index tab construction described above can be easily aligned with and attached to an edge of a mounting sheet, such as a binder divider sheet, as illustrated in the cross-sectional view of FIG. 27. Stopper 2614 engages a top edge of divider sheet 2700, indicated at 2702. After releasable backing 2622 is removed, mounting sheet 2700 is secured to the tab between adhesive layer 2618 and internal surface of pocket hinge 2616.

Figure 28:
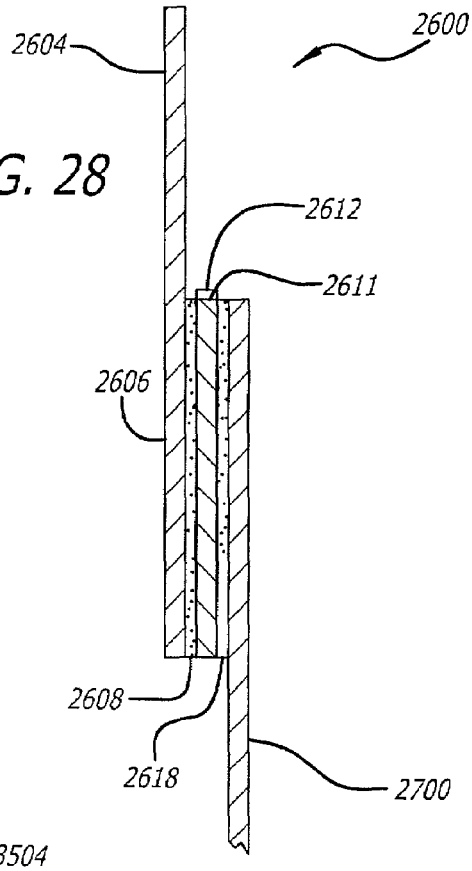
FIG. 28 is a cross-sectional view of the exemplary perforated index tab embodiment of the present invention, aligned with and attached to the edge of a mounting sheet, with a portion of the tab area removed at the perforation.

FIG. 28 is a cross-sectional view of the exemplary perforated index tab construction 2600, wherein pocket hinge 2616 and top edge stopper 2614 have been removed from pocket extension 2612 by tearing at perforation 2611. The result is that the top edge of mounting sheet 2700 is aligned with perforated hinge 2611 and, therefore, is in turn aligned with tab portion 2604

Figure 29:
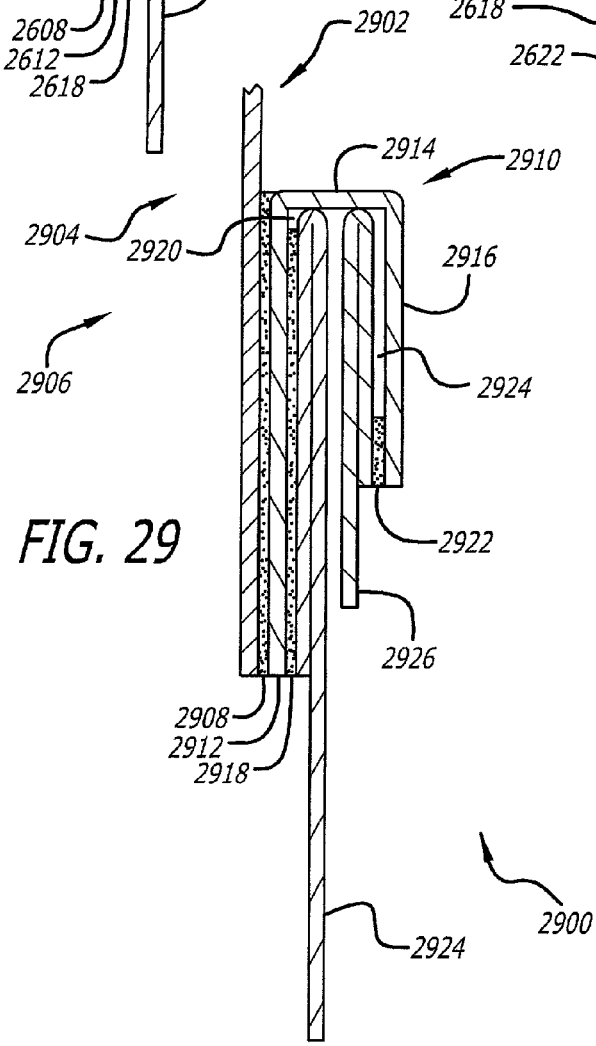
FIG. 29 is a cross-sectional view of an eighth exemplary index tab embodiment of the present invention.

FIG. 29 is a cross-sectional view of an eighth exemplary index tab construction 2900 according to the present invention. The exemplary tab comprises a single tab material layer 2902 having a tab portion 2904 and a tab extension 2906. Tab material layer 2902 may be constructed of any suitable tab material, such as card stock or various plastic materials. Tab extension 2906 has a layer of adhesive 2908 applied thereto. The adhesive may be any appropriate adhesive such as, for example, glue, permanent tacky adhesive, or heat fusing. Adhesive layer 2908 has a pocket 2910 attached to it. Pocket 2910 comprises a pocket extension 2912, a top edge stopper 2914, and a pocket hinge 2916. These three portions of pocket 2910 are preferably formed by folding a single piece of material over itself. The internal surface of pocket extension 2910 has a layer of adhesive 2918 disposed thereon. Adhesive layer 2918 is disposed such that a small gap 2920 remains between the top edge of adhesive layer 2918 and the inside top edge of stopper 2914. As described previously, gap 2920 may be included in all embodiments of the present invention and may be, for example, 1/16" to 1/8" from the inside top edge of stopper 2914. Gap 2920, in this embodiment and others, allows the tab construction 2900 to slide along a mounting sheet edge without being hindered by adhesive. Once exposed, however, adhesive layer 2918 will secure the tab to a mounting sheet when it is attached. Likewise, the internal surface of pocket hinge 2916 may have a layer of adhesive 2922 applied along its lower edge portion. This leaves a gap 2924 between the top edge of adhesive layer 2922 and the inside top edge of stopper 2914, allowing the tab construction 2900 to slide freely along a mounting sheet edge. These two layers of adhesive 2918 and 2922 will secure the tab to a mounting sheet when it is attached. A first releasable backing 2924 is applied to adhesive layer 2918 to preserve the adhesive and prevent it from adhering to the internal surface of pocket hinge 2916 or to adhesive layer 2922 prior to attachment of the tab to a mounting sheet. A second releasable backing 2926 is applied to adhesive layer 2922, also to preserve the adhesive. Second releasable backing 2926 is substantially shorter than first releasable backing 2924 in order to facilitate insertion of a mounting sheet therebetween. Both releasable backings 2924 and 2926 may be easily removed prior to attachment of the tab construction 2900 to a mounting sheet. Thus, an index tab of this invention has an integral stopper or pocket for engaging the edge of a mounting sheet such that alignment is easy and requires little user control over the position and movement of various parts of the index tab during the application process.

Figure 30:
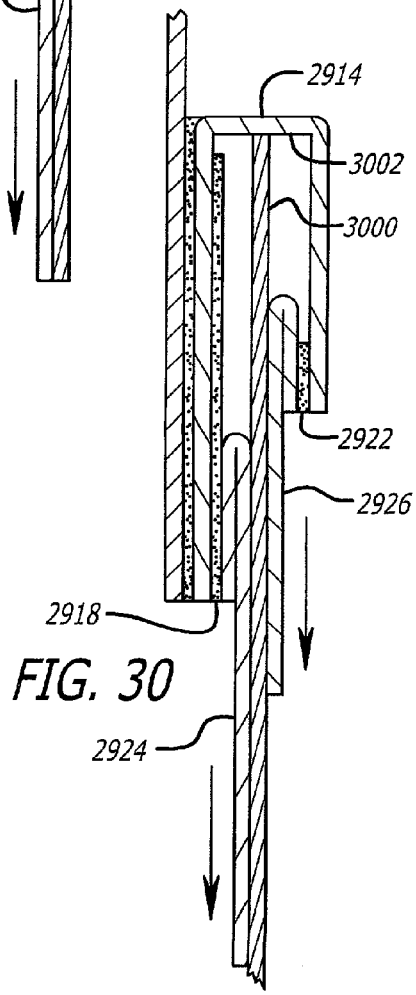
FIG. 30 illustrates alignment and application of the exemplary tab construction shown in FIG. 29 to the edge of a mounting sheet.

The index tab construction described above can be easily aligned with and attached to an edge of a mounting sheet, such as a binder divider sheet, as illustrated in the cross-sectional view of FIG. 30. Stopper 2914 engages a top edge of mounting sheet 3000, indicated at 3002. After first releasable backing 2924 and second releasable backing 2926 are removed, mounting sheet 3000 is secured to the tab between adhesive layers 2918 and 2922.

Figure 31:
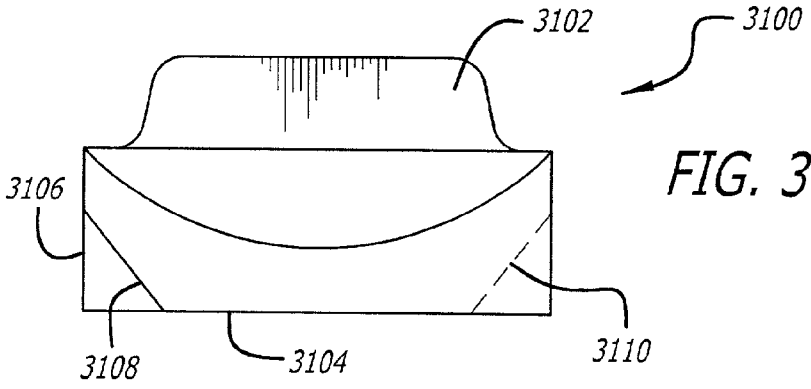
FIG. 31 illustrates an alternative releasable backing design for various exemplary embodiments of the present invention.

FIG. 31 illustrates an alternative design of the releasable backing portions for the tab construction illustrated in FIGS. 29-30. Generally, the exemplary tab construction indicated at 3100 comprises a tab portion 3102, a front releasable backing 3104 and a back releasable backing 3106. Front releasable backing 3104 has a cut therein as indicated at 3108, such that a section of the releasable backing material is removed. Similarly, back releasable backing 3106 has a cut therein as indicated at broken line 3110, such that a section of the releasable backing material is removed.

Figure 32:
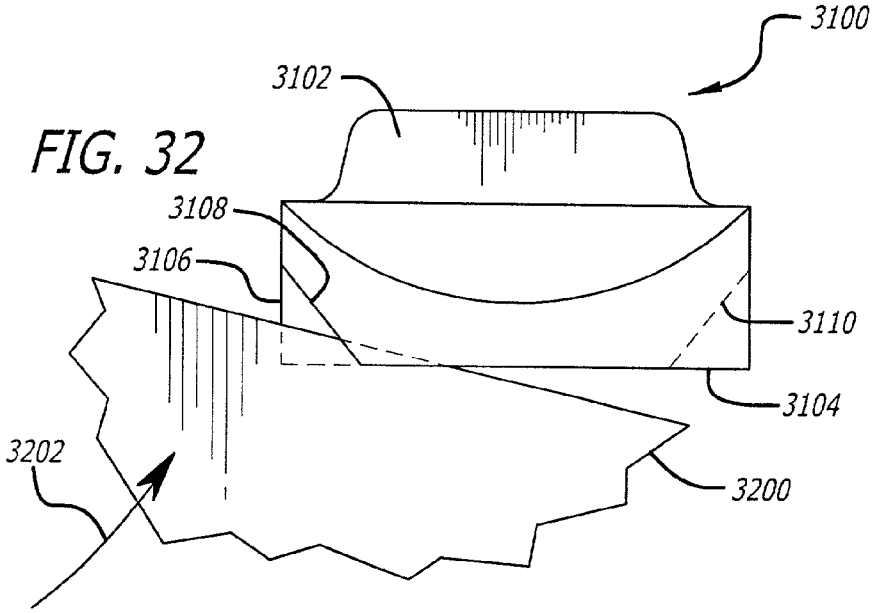
FIG. 32 illustrates application of an exemplary embodiment of the present invention to the edge of a mounting sheet utilizing the alternative releasable backing design illustrated in FIG. 31.
Figure 33:
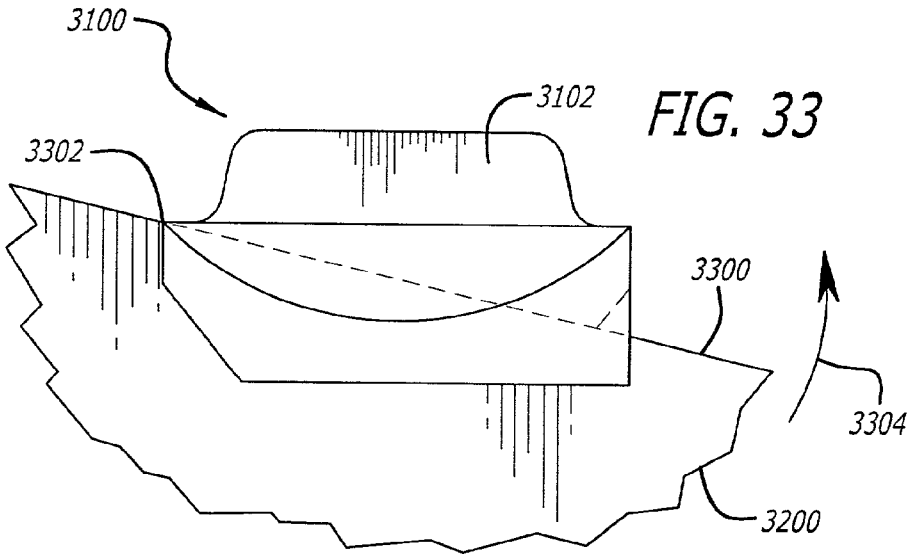
FIG. 33 further illustrates application of the exemplary embodiment of the present invention to the edge of a mounting sheet utilizing the alternative releasable backing design illustrated in FIG. 31.

Removal of this material via cuts 3108 and 3110 facilitates application of the tab assembly 3100 to a mounting sheet 3200, as illustrated in FIGS. 32 and 33. Referring first to FIG. 32, mounting sheet 3200 is extended upward, as indicated at arrow 3202, into tab assembly 3100 between front releasable backing 3104 and back releasable backing 3106. Referring now to FIG. 33, edge 3300 of mounting sheet 3200 is engaged with one edge of the stopper, shown at 3302. Once engaged with the edge of the stopper at point of engagement 3302, mounting sheet 3200 is pivoted about point of engagement 3302 and thereby moved upward, as indicated at arrow 3304, to fully extend into tab assembly 3100.

Figure 34:
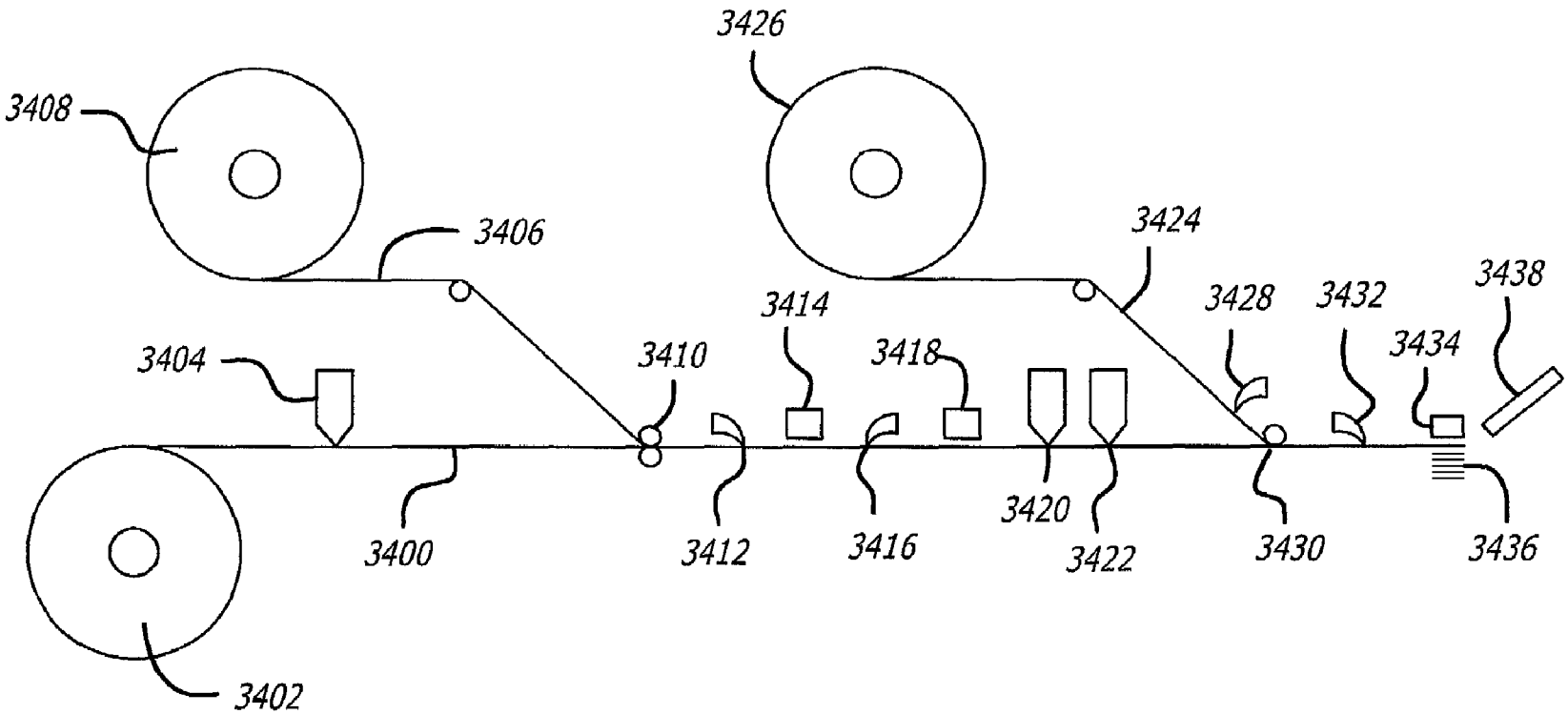
FIG. 34 illustrates an exemplary manufacturing process for an index tab constructed according to the embodiment illustrated in FIGS. 1 and 2.

Manufacturing of tabs according to the present invention may take a number of different forms. An exemplary manufacturing process, according to the first exemplary index tab embodiment of the present invention illustrated in FIGS. 1 and 2, is illustrated in FIG. 34. In the exemplary manufacturing process, tab material 3400 is drawn from roll 3402 and has adhesive applied thereto as shown at station 3404. Pocket material 3406 is drawn from roll 3408, and brought together and bonded by the adhesive as shown at station 3410. With reference also to FIG. 1, the next step in the exemplary manufacturing process involves folding hinge 114 at station 3412. Next, the top half of tab 102 is die cut at station 3414. The pocket hinge is unfolded at station 3416, and tab extension 104 is die cut at station 3418. Adhesive layer 116 is then applied, at station 3420, and adhesive layer 118 is applied at station 3422. At this point, releasable backing 3424 is fed from roll 3426, and folded as indicated at station 3428. After the folding step, the folded releasable backing 120 is brought together in contact with adhesive layer 116, as indicated at 3430. Next, at station 3432, pocket hinge 114 is folded onto folded releasable backing 120 so that adhesive layer 118 contacts folded releasable backing 120. At station 3434, folded releasable backing 120 and side edges of pocket hinge 114 are die cut to complete the tab construction. Finished tabs are produced as indicated at station 3436, and excess scrap is removed at station 3438, such as by vacuum.

Figure 35:
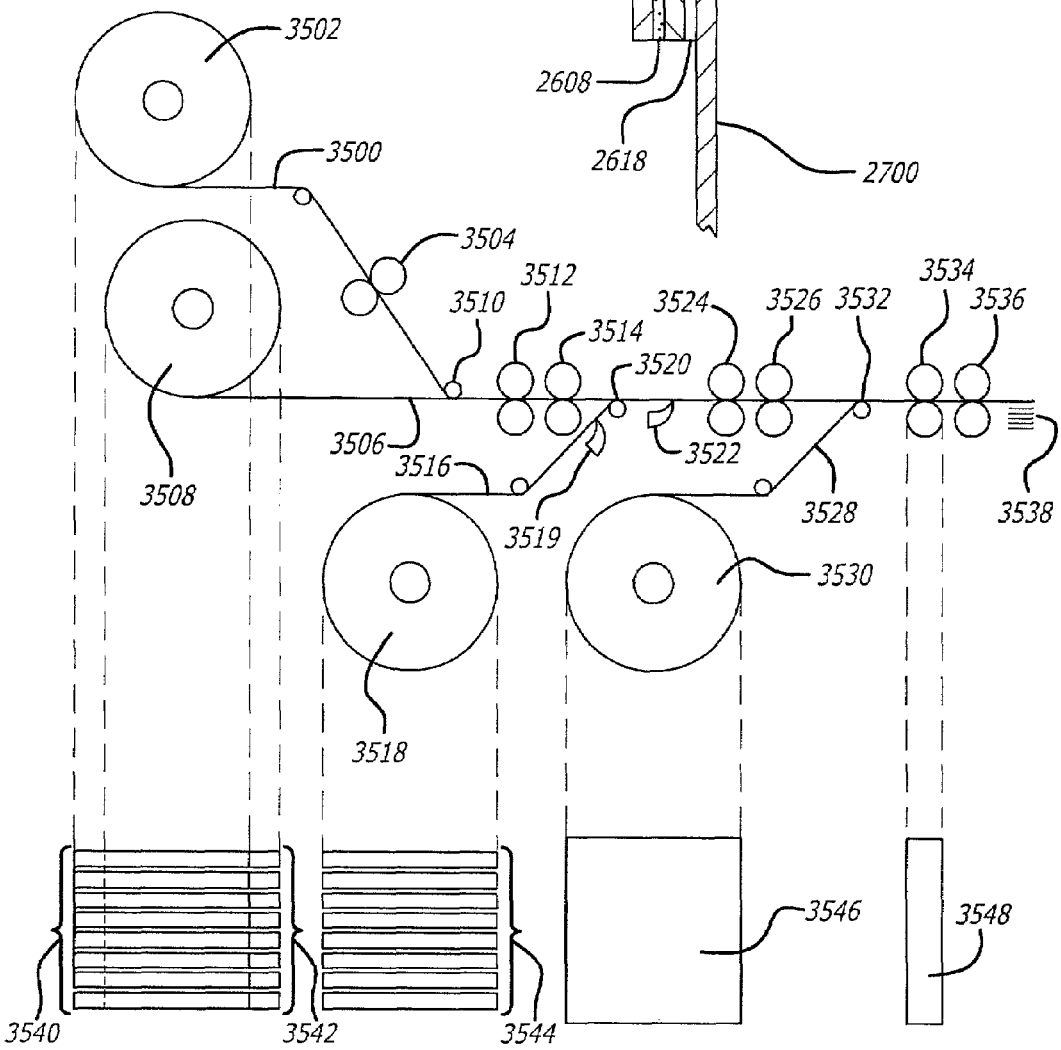
FIG. 35 illustrates an exemplary manufacturing process for an index tab constructed according to the embodiment illustrated in FIGS. 19-21.

A second exemplary manufacturing process, directed to the exemplary layered tab area embodiment of FIGS. 19-21, is illustrated in FIG. 35. In the exemplary manufacturing process, tab material 3500 is drawn from roll 3502. Next, at station 3504, adhesive is applied to the tab extension portion of tab material 3500. Pocket material 3506 is drawn from roll 3508, and joined to tab extension at station 3510, such as by adhesive or heat bonding, for example. Next, the tab extension portion of the tabs is die cut at station 3512, and adhesive is applied to the tab extension portion of the pocket at station 3514. Removable backing layer material 3516 is drawn from roll 3518, folded at station 3519 and joined to thus-far-completed partial tab construction at station 3520. The pocket is then formed by folding at station 3522, and adhesive is applied to the hinge portion of the pocket at station 3524. Then, adhesive is applied to the tab portion of the tab construction, at station 3526. A layer of backing sheet material 3528 is then drawn from roll 3530, and joined to the tab construction by the adhesive applied at stations 3524 and 3526, at station 3532. Next, individual tabs are die cut on the backing sheet, at station 3534, however, the backing sheet itself is not die cut. That is, the die cut at station 3534 is made through all the layers of the tab constructions except for the backing sheet. At station 3536, the construction is cut into multiple sheets, each sheet bearing multiple tab constructions, and finished sheets of tab constructions are dispensed at station 3538.

Many modifications and variations to the exemplary manufacturing process described above are anticipated and considered to be within the scope of the present invention. For example, and with reference to FIG. 35, there can be as many rolls of tab material 3502 as there are rows of tabs on a completed sheet, the multiplicity of rolls 3502 indicated at region 3540. An alternative might be to provide one wide roll and slit the roll into rows. Similarly, there may be as many rolls of pocket material 3508 as there are rows of tabs on a completed sheet, and, alternatively, a single, wider roll may be utilized and slit into multiple rows. The multiple rolls of pocket material 3508 are indicated at region 3542. As with the tab material and pocket material, there may be as many rolls of removable backing layer material 3518 as there are rows of tabs on a completed sheet, or a wider roll may be used and slit into multiple rows. The multiplicity of rolls is indicated at region 3544. Also, as indicated at 3546, backing sheet roll 3530 is approximately the same width as the length of a finished sheet of tabs, which may be, for example, approximately eleven inches. Similarly, and as indicated at 3548, print and die cut cylinders are approximately the same width or wider than the length of a finished sheet of tabs, which may be, for example, approximately eleven inches. It should be appreciated that eleven inches is a standard size used by way of example, but other widths may be used by methods of the present invention.

Figure 36:
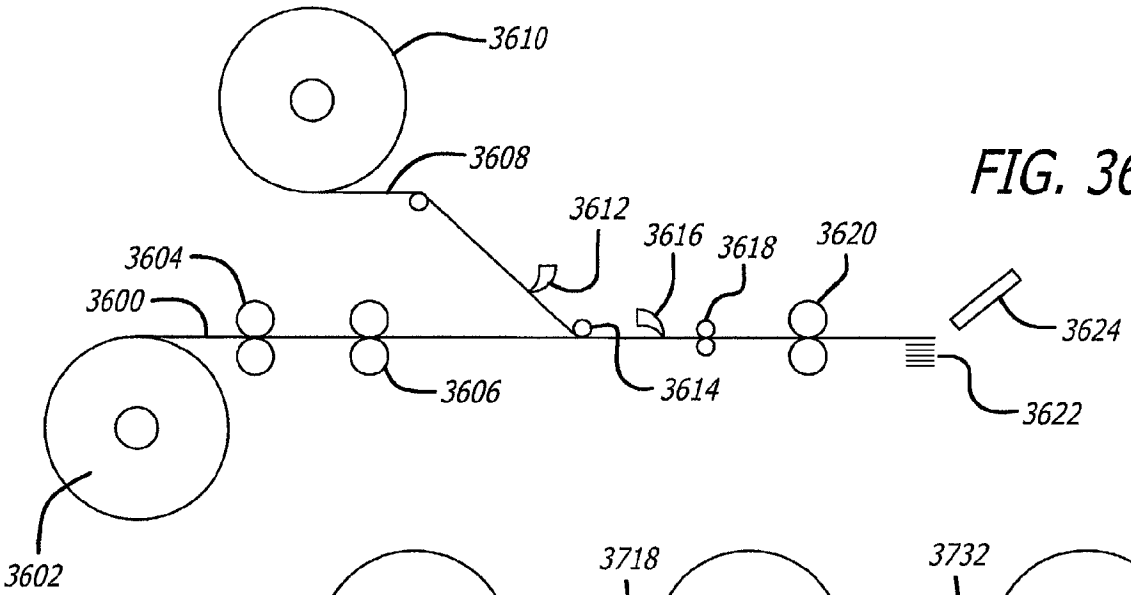
FIG. 36 illustrates an exemplary manufacturing process for an index tab constructed according to the embodiment illustrated in FIGS. 3 and 4.

FIG. 36 illustrates an exemplary manufacturing process directed to the tab embodiment illustrated in FIGS. 3 and 4. Tab material 3600, such as MYLAR or another plastic material, for example, is drawn from roll 3602. An optional station 3604 die cuts a curved shape into the tab extension portion, such that the lower edge of the tab extension portion is curved.

Adhesive is applied on the tab extension portion and, optionally, on the back hinge portion of the tab construction at station 3606. Releasable adhesive backing material 3608 is drawn from roll 3610 and folded to form an easily grippable tab at station 3612. Then, at station 3614, releasable adhesive backing material 3608 and adhesive on tab extension are brought in contact. At station 3616, tab material 3600 is folded over onto releasable adhesive backing material 3608, and at station 3618 a heat fuse is formed to join the sides of the tab area together and to create the stopper therebetween. The tabs are die cut at station 3620, and the finished tab assemblies are dispensed at station 3622, with scraps being vacuumed at station 3624.

Figure 37:
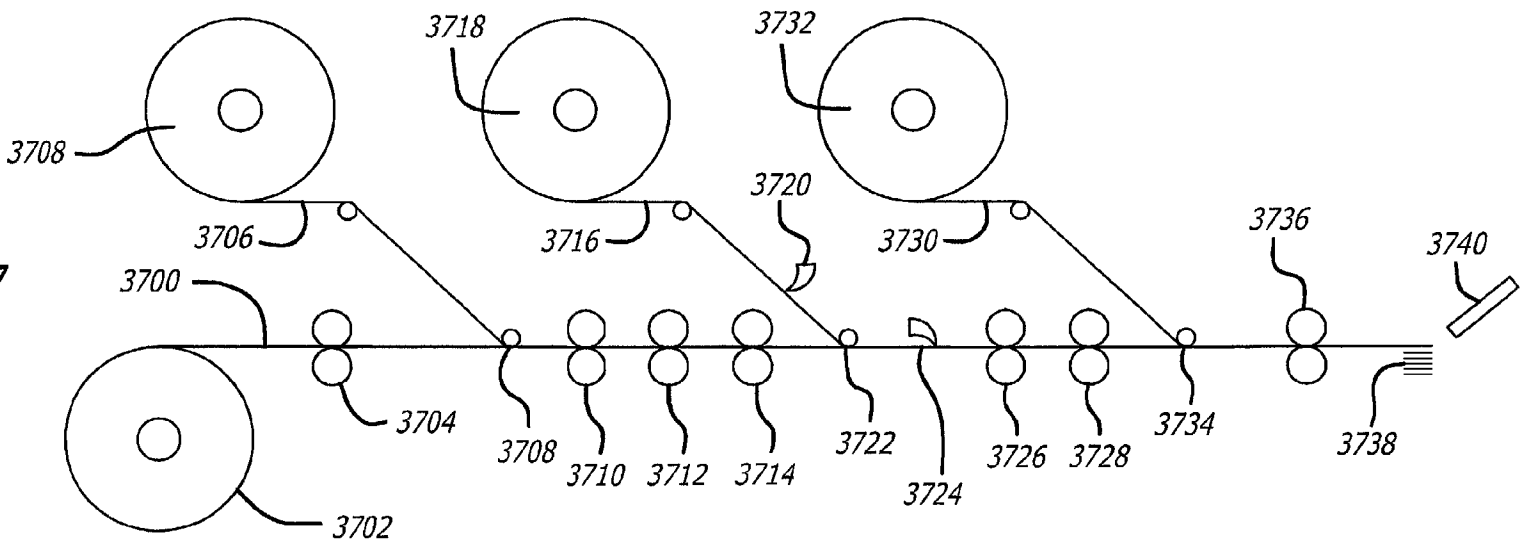
FIG. 37 illustrates an exemplary manufacturing process for an index tab constructed according to the embodiment illustrated in FIGS. 7 and 10-13.

FIG. 37 illustrates an exemplary manufacturing process directed to the tab embodiment illustrated in FIG. 7. First, tab material 3700 is drawn from roll 3702. Adhesive is applied to a tab extension portion of tab material 3700 at station 3704. Pocket material 3706 is drawn from roll 3708 and adhered to tab material 3700 at station 3708. An optional station 3710 may be employed to die cut the lower portion of the tab extension so that it has a curved shape. Adhesive is applied to the tab extension portion of pocket material 3706 at station 3712 and, optionally, adhesive may be applied on the back hinge portion of pocket material 3706 at an optional station 3714. Releasable adhesive backing material 3716 is drawn from roll 3718 and folded at station 3720 to form an easily grippable tab. Releasable backing material 3716 is then applied to pocket adhesive at station 3722, and pocket material 3706 is folded at station 3724. Adhesive is applied to the tab portion of tab material 3700 at station 3726, and to the outer portion of the pocket hinge at station 3728. Second tab material 3730 is drawn from roll 3732 and joined to the first tab material 3700 and pocket at station 3734. Finally, individual tabs are die cut at station 3736, and individual tabs are dispensed at station 3738 while excess scrap from the die cutting step is removed at vacuum station 3740.

Figure 38:
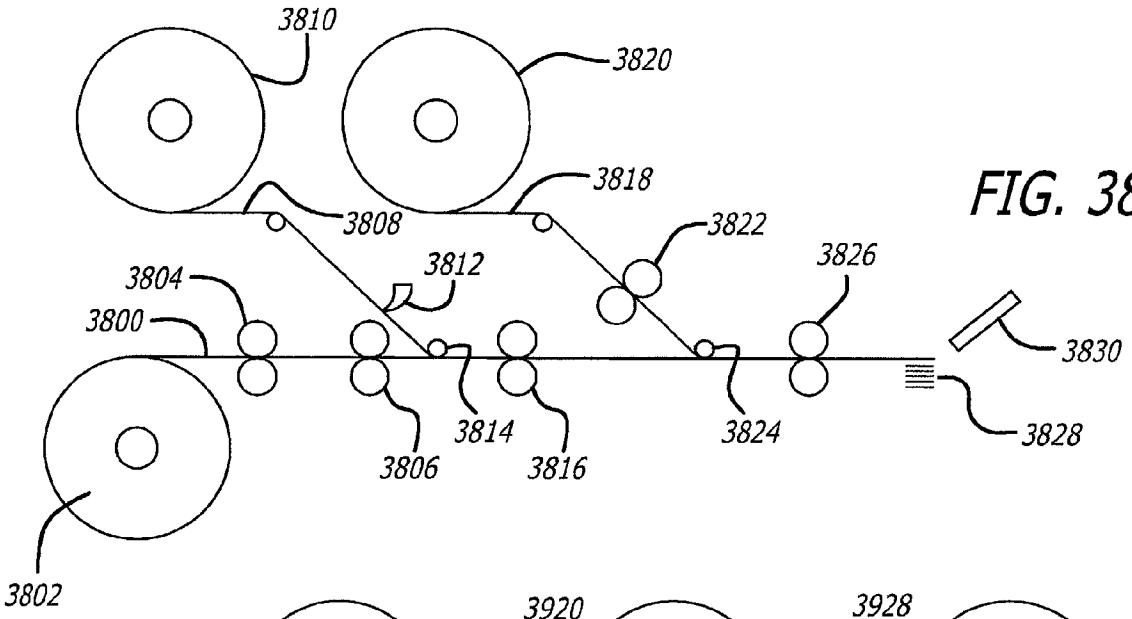
FIG. 38 illustrates an exemplary manufacturing process for an index tab constructed according to the embodiment illustrated in FIG. 8.

An exemplary manufacturing process directed to the tab embodiment of FIG. 8 is illustrated in FIG. 38. First tab material 3800 is drawn from roll 3802. An optional station 3804 may be employed to die cut a curved portion of a tab extension. Next, adhesive is applied to the tab extension portion of first tab material 3800 at station 3806. Releasable adhesive backing 3808 is drawn from roll 3810 and folded at station 3812 to form an easily grippable tab. Then, at station 3814, releasable adhesive backing material is contacted with the adhesive on first tab material 3800. Adhesive is then applied to the tab portion of first tab material 3800 at station 3816. Second tab material 3818 is drawn from roll 3820, and at an optional station 3822, adhesive may be applied to the hinge portion of second tab material 3818. Second tab material 3818 is joined to the tab construction at station 3824. Finally, individual tabs are die cut at station 3826, and finished tabs are dispensed at station 3828 while excess scraps from die cutting are removed at vacuum station 3828.

Figure 39:
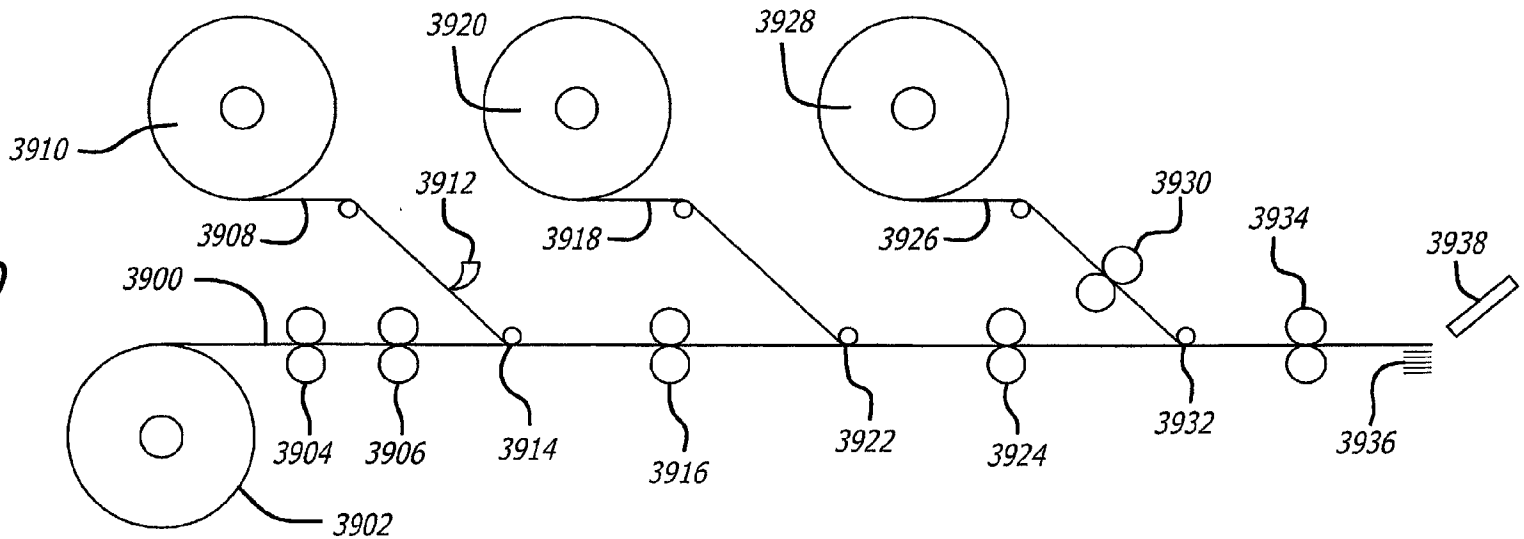
FIG. 39 illustrates an exemplary manufacturing process for an index tab constructed according to the embodiment illustrated in FIG. 9.

Yet another exemplary manufacturing process, directed to the tab embodiment of FIG. 9, is illustrated in FIG. 39. First tab material 3900 is drawn from roll 3902. An optional die cutting station 3904 may be employed to create a curved portion for a tab extension in first tab material 3900. Adhesive is applied to the tab extension portion of first tab material 3900 at station 3906. Releasable backing material 3908 is drawn from roll 3910 and folded at folding station 3912. Releasable backing material is then contacted to the adhesive on first tab material 3900 at station 3914, and adhesive is applied to the tab portion of first tab material 3900 at station 3916. Stopper material 3918 is drawn from roll 3920 and joined, such as by adhesive or heat fusing, to first tab material 3900 at station 3922. Adhesive is applied on stopper material 3918 at station 3924. Second tab material 3926 is drawn from roll 3928, and an optional station 3930 may be employed to apply adhesive to the back hinge portion of second tab material 3926. Next, second tab material 3926 is adhered to stopper material 3918 at station 3932. Finally, individual tabs are die cut at cutting station 3934, finished tabs are dispensed at station 3936 and excess scrap is removed at vacuum station 3938.

Figure 40:
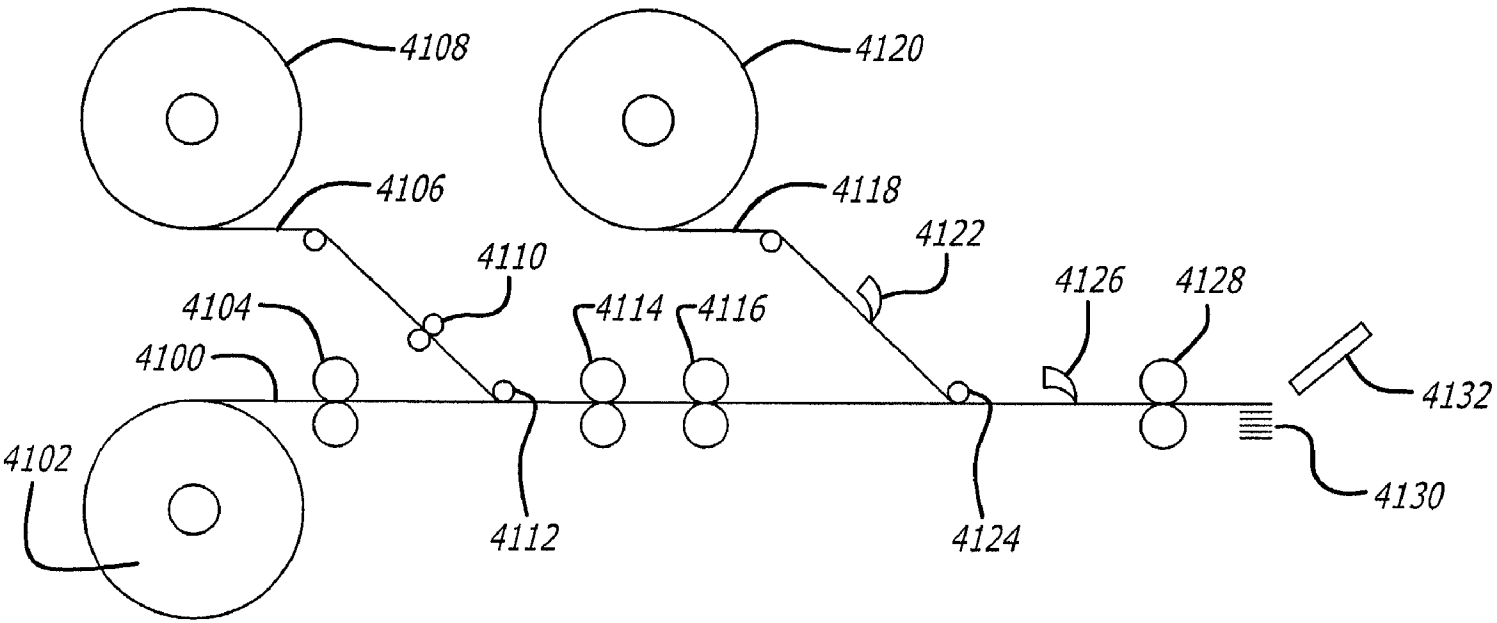
FIG. 40 illustrates an exemplary manufacturing process for an index tab constructed according to the embodiment illustrated in FIGS. 26-28.

FIG. 40 illustrates an exemplary manufacturing process for a perforated tab construction having a removable tab portion as illustrated in FIGS. 26-28. First, tab material 4100 is drawn from roll 4102. Adhesive is then applied to the tab extension portion of tab material 4100 at station 4104. Pocket material 4106 is drawn from roll 4108 and scored or perforated to form a back hinge removal point at cutting station 4110. Pocket material 4106 is then joined to tab material 4100, such as by adhesive or heat fusing, at station 4112. An optional cutting station 4114 may be employed to die cut a curved portion of the tab extension. Next, adhesive is applied to the tab extension portion of pocket material 4106 at station 4116. Releasable adhesive backing material 4118 is drawn from roll 4120 and folded at folding station 4122. Then releasable backing material 4118 is brought into contact with adhesive on pocket material 4106 at station 4124. Next, a back hinge is folded at folding station 4126. Finally, individual tabs are die cut at cutting station 4128, dispensed at station 4130, and excess cutting scraps are removed at vacuum station 4132.

Figure 41:
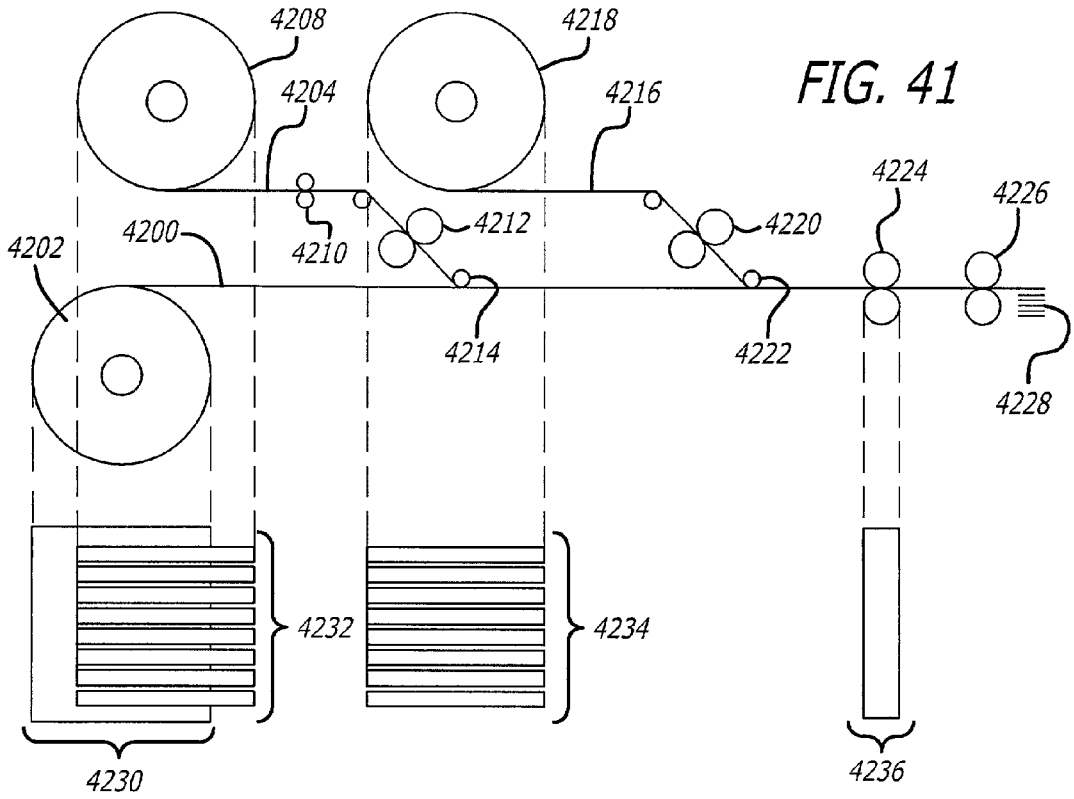
FIG. 41 illustrates an exemplary manufacturing process for an index tab having a removable hinge as illustrated in FIGS. 17-18.

FIG. 41 illustrates an exemplary manufacturing process for a tab construction as illustrated in FIGS. 17 and 18. Backing sheet material 4200 is drawn from roll 4202. Pocket material 4204 is drawn from roll 4208. A pocket fold line is then scored or perforated at cutting station 4210. Next, adhesive is applied to the tab extension and back hinge portions of pocket material 4204 at station 4212, and pocket material 4202 is joined to backing sheet material 4200 at station 4214. Tab material 4216 is drawn from roll 4218, and adhesive is applied to tab extension portion at station 4220. Tab material 4216 is then joined to pocket material 4204 at station 4222. Next, tab outlines are die cut on backing sheet material 4200 without actually cutting backing sheet material 4200, at cutting station 4224. Finally, the construction, considered a "web," is cut into sheets at cutting station 4226, and finished tab bearing sheets, comprising multiple tabs each, are dispensed at station 4228.

Still referring to FIG. 41, backing sheet roll 4202 is approximately the same width as the length of the finished sheet as indicated at area 4230. As indicated at region 4232, there are as many rolls of pocket material 4208 as there are rows of tabs on a finished sheet. Alternatively, one wide roll may be provided and then slit into rows. As with pocket material 4202, there are as many rolls of tab material 4218 as there are rows of tabs on the sheet, as indicated at region 4234. Again, an alternative approach is to provide a wider roll and slit it into the number of rows of tabs on the sheet. Also, print and die cut cylinders will be approximately the same width or wider than the length of the finished sheet, as indicated at area 4236.

Figure 42:
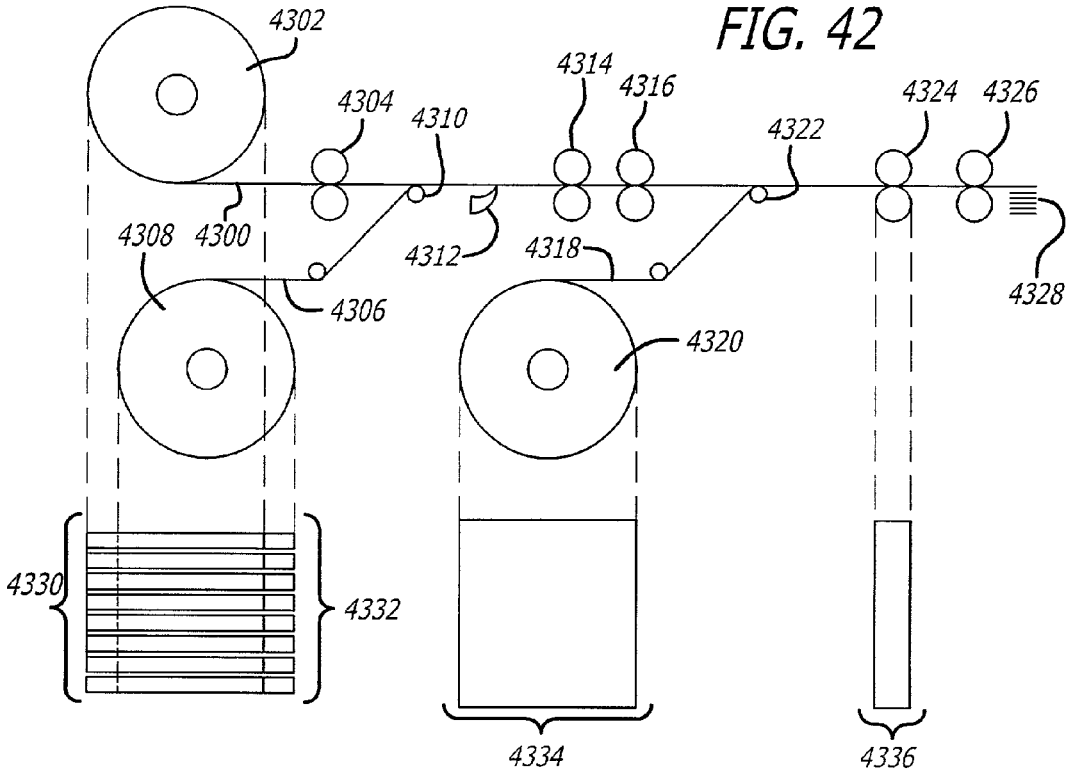
FIG. 42 illustrates an exemplary manufacturing process for an index tab constructed according to the embodiment illustrated in FIGS. 22 and 24.

FIG. 42 illustrates yet another exemplary manufacturing process for a tab construction such as that illustrated in FIGS. 22 and 24. First tab material 4300 is drawn from roll 4302 and adhesive is applied to tab portion at station 4304. Second tab material 4306 is drawn from roll 4308 and joined to first tab material 4300 at station 4310. Second tab material 4306 is then folded at folding station 4312. Adhesive is applied to second tab material 4306 at station 4314. Similarly, adhesive is applied to the tab extension portion of first tab material 4300 at station 4316. Backing sheet material 4318 is drawn from roll 4320 and joined to tab construction strips at station 4322. Next, individual tabs are die cut on the backing sheet 4318 without actually cutting the backing sheet at cutting station 4324. The resultant web is then cut into sheets at cutting station 4326, and finished tab-bearing sheets are dispensed at station 4328.

Still referring to FIG. 42, there are as many rolls 4302 of first tab material as there are rows of tabs on the sheet, as indicated at region 4330. Alternatively, a wider roll may be utilized and cut into strips according to the number of rows of tabs on the finished sheets. As indicated at region 4332, there are as many rolls 4308 of second tab material as there are rows of tabs on a finished sheet, with an alternative being to use a wider roll slit into the number of rows of tabs on a finished sheet. Also, backing sheet roll 4320 is approximately the same width as the length of the finished sheet, as indicated at region 4334, and print and die cut cylinders 4324 will be approximately the same width or wider than the length of the finished sheet, as indicated at area 4336.

It is to be understood that the manufacturing processes illustrated in FIGS. 34 through 42 are exemplary, and that many modifications and variations are anticipated to be within the scope of the present invention. For example, manufacturing processes for constructing the first exemplary tab embodiment may comprise steps which occur in a different order than those set forth in FIG. 34. One possible variation is that the die cut which occurs at station 3414 may occur before the adhesive application at station 3404. In that case, the folding step at station 3412 and the unfolding step at station 3416 would not be necessary. Alternatively, the adhesive application steps at stations 3420 and 3422 may be combined to be a single process step. Of course, many other variations are also possible. Moreover, with regard to the various exemplary tab embodiments disclosed herein and otherwise covered by the present invention, manufacturing processes will differ accordingly.

The foregoing description of exemplary embodiments of the present invention has been presented for purposes of enablement, illustration, and description. They are not intended to be exhaustive of or to limit the present invention to the precise forms discussed. Many modifications and variations of the present invention are possible in light of the above teachings. For example, various arrangements and types of layers may be used to form the stopper or pocket of the present invention. Also, the present invention is not limited to use with paper or plastic tabs, as presented in the exemplary embodiments, but may be utilized with any of a number of different suitable materials. Such materials are considered to include materials that are writeable. That is, tabs constructed in accordance with the teachings herein may be written on, such as with a pen, pencil, computer printer, or other writing implement. Moreover, different parts of the present invention may be practiced with the use of different materials. For example, a tab according to the present invention may be constructed to have a tab portion comprising a first material and a pocket or stopper comprising a second, different material. Also, the folding of the releasable backing strip to form an easily grippable tab can be applied to all embodiments having a releasable backing strip.

What is claimed is:

1. An index tab, comprising:
a tab portion;
a pocket attached to a lower edge of said tab portion;
said pocket including a top edge, a hinge portion and a pocket extension portion;
wherein said hinge portion and said pocket extension portion are operatively connected by said top edge;
wherein the tab portion comprises a single layer of card stock;
said pocket receives and is adhered with adhesive to a mounting sheet; and
an edge of said mounting sheet is aligned with said top edge of said pocket.

2. An index tab, comprising:
a tab portion;
a pocket attached to a lower edge of said tab portion;
said pocket including a top edge, a hinge portion and a pocket extension portion;
said hinge portion and said pocket extension portion being operatively connected by said top edge;
said tab portion comprising a single layer of card stock;
said hinge portion being substantially shorter than said pocket extension portion; and
said socket including a first layer of adhesive on an inner surface of said pocket extension portion.

3. The index tab of claim 2 wherein the substantially shorter hinge portion is at least ⅛ inch shorter than said pocket extension portion.

4. The index tab of claim 2 wherein said first layer of adhesive is applied from a bottom edge of said pocket extension portion to within ⅛ inch to 1/16 inch of said pocket top edge.

5. The index tab of claim 2 wherein said pocket further comprises a second layer of adhesive on an inner surface of said hinge portion.

6. The index tab of claim 5 wherein said second layer of adhesive is applied from a bottom edge of said hinge portion to within ⅛ inch to 1/16 inch of said pocket top edge.

7. The index tab of claim 5 wherein said first and second layers of adhesive are protected by a releasable backing.

8. The index tab of claim 7 wherein said releasable backing is folded and extends downward below said index tab to facilitate removal.

9. The index tab of claim 7 wherein said releasable backing is folded to form an easily grippable tab.

10. The index tab of claim 5 wherein said adhesive of at least one of said first and second layers is permanent adhesive.

11. The index tab of claim 5 wherein said adhesive of at least one of said first and second layers is removable adhesive.

12. An index tab-bearing sheet capable of being passed through a printer or copier, the index tab-bearing sheet having a plurality of tab areas defined thereon, each of said tab areas comprising:
a first layer of tab material;
a second layer of adhesive applied to a lower portion of said first layer of tab material;
a third layer of pocket material applied to said second layer of adhesive and having a pocket told line aligned with an upper edge of said second layer of adhesive;
a lower fourth layer of adhesive applied to said third layer of pocket material below said pocket fold line;
an upper fourth layer of adhesive applied to an upper edge portion of said third layer of pocket material; and
a releasable backing sheet applied to at least one said lower and upper fourth layers of adhesive; whereby said index tab-bearing sheet can be passed through a printer or copier for a printing operation on the tab areas.

13. The index tab-bearing sheet of claim 12 wherein said pocket fold line is a score line.

14. The index tab-bearing sheet of claim 12 wherein said first layer of tab material is card stock.

15. The index tab-bearing sheet of claim 12 wherein said first layer of tab material is plastic.

16. A method of using an index tab, comprising:

removing said index tab from an index tab bearing sheet;

aligning a first surface edge of a mounting sheet with a top edge of a pocket formed by folding a hinge portion of a tab hinge at a pocket fold line;

attaching said first surface edge of a mounting sheet to an exposed layer of adhesive, said exposed layer of adhesive located on an inside surface of a tab extension;

folding said tab hinge downward, said tab hinge comprising a strip layer of adhesive along an upper edge thereof; and said folding causing said strip layer of adhesive to contact a second surface edge of said mounting sheet, said second surface edge opposing said first surface edge.

17. The method of claim 16, further comprising processing the index tab bearing sheet through a printer to print indicia on the index tab.

18. An index tab, comprising:

a tab member having a tab upper portion and a tab lower portion;

a downwardly-disposed, generally U-shaped pocket having an inner leg and an outer leg;

a face of the inner leg attached to a face of the tab lower portion;

the upper tab portion extending upwardly from the pocket and having an upper freestanding end;

the tab member comprising a single layer of card stock; and the pocket including adhesive on an inner surface of the outer leg.

19. The index tab of claim 18 wherein the pocket is adapted to receive and to be attached to a mounting sheet with an edge of the mounting sheet aligned with a top of the pocket.

20. The index tab of claim 18 wherein a lower edge of at least one of the tab lower and upper portions and a lower edge of the inner leg are substantially curved.

21. The index tab of claim 20 wherein the edges are substantially curved in upwardly directions.

22. The index tab of claim 18 wherein the face of the inner leg is attached to the face of the tab lower portion with adhesive.

23. The index tab of claim 18 wherein the outer leg is substantially shorter than the inner leg.

24. The index tab of claim 18 wherein the outer leg is at least one-eighth inch shorter than the inner leg.

25. The index tab of claim 18 wherein the pocket includes adhesive on a surface of the inner leg.

26. The index tab of claim 25 wherein the adhesive extends from a bottom edge of the inner leg to within one-eighth inch to one-sixteenth inch of a top of the pocket.

27. The index tab of claim 25 wherein the adhesive on the inner surface of the outer leg extends from a bottom edge of the outer leg to within one-eighth to one-sixteenth inch of the top of the pocket.

28. The index tab of claim 25 wherein the adhesive on the inner leg is protected by a releasable backing.

29. The index tab of claim 28 wherein the releasable backing is folded and extends downward below the lower tab portion to facilitate removal thereof.

30. The index tab of claim 29 wherein the releasable backing is folded to form a grippable tab.

31. The index tab of claim 25 wherein the adhesives are permanent adhesive.

32. The index tab of claim 25 wherein the adhesives are removable adhesive.

33. The index tab of claim 25 further comprising a first releasable backing attached to the adhesive on the inner leg and a second releasable backing attached to the adhesive on the outer leg.

34. The index tab of claim 33 wherein the second releasable backing extends a substantially shorter distance than the first releasable backing extends.

35. The index tab of claim 25 wherein the inner and outer legs are formed by a folded-over piece of material.

36. The index tab of claim 25 wherein the inner leg is attached to the lower tab portion with adhesive.

37. An index tab, comprising:

a tab portion;

a pocket attached to a lower edge of said tab portion; and said pocket including a top edge, a hinge portion and a pocket extension portion;

wherein said hinge portion and said pocket extension portion are operatively connected by said top edge;

wherein said hinge portion is substantially shorter than said pocket extension portion;

wherein the substantially shorter hinge portion is at least ⅛ inch shorter than said pocket extension portion;

wherein said tab portion comprises a single layer of cardstock; and wherein said pocket comprises a first layer of adhesive on an inner surface of said pocket extension portion.

38. The index tab of claim 37 wherein a lower edge of said tab portion and a lower edge of said pocket extension portion are substantially curved.

39. The index tab of claim 37 wherein said pocket is attached to said lower edge of said tab portion with adhesive.

40. The index tab of claim 37 wherein said first layer of adhesive is applied from a bottom edge of said pocket extension portion to within ⅛ inch to 1/16 inch of said pocket top edge.

41. The index tab of claim 37 wherein said pocket further comprises a second layer of adhesive on an inner surface of said hinge portion.

42. The index tab of claim 41 wherein said second layer of adhesive is applied from a bottom edge of said hinge portion to within ⅛ inch to 1/16 inch of said pocket top edge.

43. The index tab of claim 41 wherein said first and second layers of adhesive are protected by a releasable backing.

44. The index tab of claim 43 wherein said releasable backing is folded and extends downward below said index tab to facilitate removal.

45. The index tab of claim 44 wherein said releasable backing is folded to form an easily grippable tab.

46. The index tab of claim 41 further comprising a first releasable backing attached to said first layer of adhesive and a second releasable backing attached to said second layer of adhesive.

47. An index tab bearing sheet, comprising:

a sheet construction including a sheet upper surface and a removable index tab on the upper surface and removable therefrom;

the removable index tab including a pocket adapted to be formed by a hinge portion of a tab hinge folded at a pocket fold line;

the removable index tab including a tab extension and adhesive on the tab extension;

wherein the removable index tab includes adhesive on the tab hinge; and wherein the removable index tab is adapted to be mounted on an edge of a mounting sheet with the removable index tab removed from the sheet construction, a top edge of the pocket aligned with an edge of the mounting sheet, the tab extension attached to the mounting sheet on one sheet side with the tab extension adhesive and the tab hinge attached to the mounting sheet on another sheet side with the tab hinge adhesive.

48. An index tab bearing sheet, comprising:

a sheet construction including a sheet upper surface and a removable index tab on the upper surface and removable therefrom;

the removable index tab including a pocket adapted to be formed by a hinge portion of a tab hinge folded at a pocket fold line;

the removable index tab including a tab extension and adhesive on the tab extension; and the removable index tab being adapted to be mounted on an edge of a mounting sheet with the removable index tab removed from the sheet construction, a top edge of the pocket aligned with an edge of the mounting sheet and the tab extension attached to the mounting sheet with the tab extension adhesive.

49. An index tab bearing sheet, comprising:

a sheet construction including a sheet upper surface and a removable index tab on the upper surface and removable therefrom;

the removable index tab including a pocket adapted to be formed by a hinge portion of a tab hinge folded at a pocket fold line;

the removable index tab including a tab extension and adhesive on an inner face of the tab extension;

the removable index tab including a tab portion;

the pocket being attached to a lower edge of the tab portion; and the tab portion having a freestanding and unattached upper end.

50. The sheet of claim 49 wherein the tab portion comprises a single layer of card stock.

51. An index tab, comprising:

a tab portion;

a pocket attached to a lower edge of the tab portion;

the pocket including a top edge, a hinge portion and a pocket extension portion;

the hinge portion and the pocket extension portion being operatively connected together by the top edge;

the tab portion extending up a distance above the pocket and an upper end edge of the tab portion being unattached and freestanding;

an upper edge of the tab portion being a single layer; and adhesive on an inside surface of the pocket extension portion.

52. The index tab of claim 51 wherein the pocket extension portion is longer than the hinge portion.

53. The index tab of claim 51 wherein a lower face portion of the tab portion is attached to an outer face of the pocket extension portion.

54. The index tab of claim 51 wherein the pocket is adapted to receive a mounting substrate therein.

55. The index tab of claim 54 wherein an edge of the mounting sheet is aligned with and generally abutting the top edge of the pocket.

56. The index tab of claim 51 wherein the tab portion is attached to an outside surface of the pocket.

57. The index tab of claim 51 wherein the single layer is a single layer of card stock.

58. The index tab of claim 51 further comprising a mounting sheet received in and attached to the pocket.

59. An index tab, comprising:

a tab portion;

a pocket attached to a lower edge of the tab portion;

the pocket including a top edge, a hinge portion and a pocket extension portion;

the hinge portion and the pocket extension portion being operatively connected together by the top edge;

the tab portion being attached to the pocket on only one side of the pocket;

the tab portion being attached to an outside surface of the pocket on the one side of the pocket; and adhesive on an inner surface of the pocket extension portion.

60. The index tab of claim 59 wherein adhesive attaches the tab portion to the outside surface.

61. The index tab of claim 59 wherein the tab portion comprises a single layer of card stock.

62. The index tab of claim 59 further comprising a mounting sheet received in and attached to the pocket.

63. The index tab of claim 62 wherein an edge of the mounting sheet is aligned with and generally abutting the top edge of the pocket.

64. The index tab of claim 59 wherein the pocket extension portion is longer than the hinge portion.

65. The index tab of claim 59 wherein the pocket is adapted to receive a mounting substrate therein.

66. The index tab of claim 65 wherein the tab portion lies in a plane which is spaced an offset distance from and parallel to a plane of the mounting substrate when received in the pocket.

67. The index tab of claim 59 wherein an upper end of the tab portion is a single layer.

68. The index tab of claim 67 wherein the single layer is a single layer of card stock.

69. An index tab, comprising:

a tab portion;

a pocket attached to a lower edge of the tab portion;

the pocket including a top edge, a hinge portion and a pocket extension portion;

the hinge portion and the pocket extension portion being operatively connected together by the top edge;

the tab portion being outside of and attached to the pocket;

adhesive on an inner surface of the pocket extension portion;

adhesive on an inner surface of the hinge portion;

a releasable backing protecting the adhesive on the pocket extension portion and the adhesive on the hinge portion;

the releasable backing being folded and extending downward below the pocket extension portion and the hinge portion to facilitate removal from the pocket; and an upper end of the tab portion is freestanding and unattached.

70. An index tab, comprising:

a tab portion;

a pocket attached to a lower edge of the tab portion;

the pocket including a top edge, a hinge portion and a pocket extension portion;

the hinge portion and the pocket extension portion being operatively connected together by the top edge;

the tab portion being outside of and attached to the pocket;

adhesive on an inner surface of the pocket extension portion;

adhesive on an inner surface of the hinge portion;

a releasable backing protecting the adhesive on the pocket extension portion and the adhesive on the hinge portion;

the releasable backing being folded to form a grippable removal tab; and an upper end of the tab portion is freestanding and unattached.

71. An index tab, comprising:

a tab member having a tab upper portion and a tab lower portion;

a downwardly-disposed, generally U-shaped pocket having an inner leg and an outer leg;

a face of the inner leg attached to a face of the tab lower portion;

the upper tab portion extending upwardly from the pocket and having an upper freestanding end;

the pocket including adhesive on a surface of the inner leg;

the pocket including adhesive on an inner surface of the outer leg;

a first releasable backing attached to the adhesive on the inner leg; and a second releasable backing attached to the adhesive on the outer leg.

72. The index tab of claim 71 wherein the adhesive on the inner surface of the outer leg extends from a bottom edge of the outer leg to within one-eighth to one-sixteenth inch of the top of the pocket.

73. The index tab of claim 71 wherein the adhesive on the inner leg is protected by a releasable backing.

74. The index tab of claim 73 wherein the releasable backing is folded and extends downward below the lower tab portion to facilitate removal thereof.

75. The index tab of claim 74 wherein the releasable backing is folded to form a grippable tab.

76. The index tab of claim 71 wherein the adhesives are permanent adhesive.

77. The index tab of claim 71 wherein the adhesives are removable adhesive.

78. The index tab of claim 71 wherein the second releasable backing extends a substantially shorter distance than the first releasable backing extends.

79. The index tab of claim 71 wherein the inner and outer legs are formed by a folded-over piece of material.

80. The index tab of claim 71 wherein the inner leg is attached to the lower tab portion with adhesive.

81. An index tab, comprising:

a tab portion;

a pocket attached to a lower edge of said tab portion;

said pocket including a top edge, a hinge portion and a pocket extension portion;

said hinge portion and said pocket extension portion being operatively connected by said top edge;

said hinge portion being substantially shorter than said pocket extension portion;

the substantially shorter hinge portion being at least ⅛ inch shorter than said pocket extension portion;

said pocket further comprising a first layer of adhesive on an inner surface of said pocket extension portion;

said pocket further comprising a second layer of adhesive on an inner surface of said hinge portion;

a first releasable backing attached to said first layer of adhesive; and a second releasable backing attached to said second layer of adhesive.

82. The index tab of claim 81 wherein said first and second layers of adhesive are protected by a releasable backing.

83. The index tab of claim 82 wherein said releasable backing is folded and extends downward below said index tab to facilitate removal.

84. The index tab of claim 83 wherein said releasable backing is folded to form an easily grippable tab.

85. An index tab, comprising:

a tab portion;

a pocket attached to a lower edge of the tab portion;

the pocket including a top edge, a hinge portion and a pocket extension portion;

the hinge portion and the pocket extension portion being operatively connected together by the top edge;

the tab portion extending up a distance above the pocket and an upper end edge of the tab portion being unattached and freestanding;

an entire central plane of the tab portion being outside of the pocket and spaced an offset distance from and parallel to a central plane of the pocket; and adhesive on an inner surface of the pocket extension portion.

86. The index tab of claim 85 wherein the pocket extension portion is longer than the hinge portion.

87. The index tab of claim 85 wherein a lower face portion of the tab portion is attached to an outer face of the pocket extension portion.

88. The index tab of claim 85 wherein the tab portion is attached to an outside surface of the pocket.

89. The index tab of claim 85 wherein an upper edge of the tab portion is a single layer.

90. The index tab of claim 89 wherein the single layer is a single layer of card stock.

91. The index tab of claim 85 further comprising a mounting sheet received in and attached to the pocket.

92. The index tab of claim 91 wherein an edge of the mounting sheet is aligned with and generally abutting the top edge of the pocket.

* * * * *